US009435116B2

(12) United States Patent
Melesky

(10) Patent No.: US 9,435,116 B2
(45) **Date of Patent: *Sep. 6, 2016**

(54) SYSTEMS AND METHODS FOR INSULATING ATTIC OPENINGS

(71) Applicant: James B. Melesky, Malvern, PA (US)

(72) Inventor: James B. Melesky, Malvern, PA (US)

(73) Assignee: James B. Melesky, Malvern, PA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/880,969

(22) Filed: Oct. 12, 2015

(65) Prior Publication Data

US 2016/0032641 A1 Feb. 4, 2016

Related U.S. Application Data

(60) Continuation of application No. 14/139,446, filed on Dec. 23, 2013, now Pat. No. 9,260,858, which is a division of application No. 13/191,418, filed on Jul. 26, 2011, now Pat. No. 8,661,750, which is a (Continued)

(51) Int. Cl.
*E04H 9/16* (2006.01)
*E04B 1/76* (2006.01)

(Continued)

(52) U.S. Cl.
CPC ..... *E04B 1/7654* (2013.01); *E04B 1/66* (2013.01); *E04B 1/74* (2013.01); *E04B 1/7608* (2013.01); *E04B 9/001* (2013.01); *E04B 9/003* (2013.01);

(Continued)

(58) Field of Classification Search
CPC ..... E06B 1/04; E06B 7/16; E06B 3/30; E06B 3/263; E06B 3/26; E06B 5/00; E06B 3/67; E04H 9/16; E04B 1/74; E04B 1/76; E04B 1/7654; E04B 1/7608; E04D 13/1618; E04D 13/1625; E04D 13/1637; E04D 12/00; E04D 3/38; E04D 13/358; E04D 13/357; E04D 13/35; E04D 13/06; E04F 11/06
USPC ..... 52/205, 19, 202, 317, 198, 199, 169.6, 52/20; 182/46, 47, 77
See application file for complete search history.

(56) References Cited

U.S. PATENT DOCUMENTS 33,592 A 10/1861 McIlwain
541,987 A 7/1895 Whiteside (Continued)

FOREIGN PATENT DOCUMENTS

EP 0047996 A2 3/1982

OTHER PUBLICATIONS

"Installing an Attic Tent to seal Scuttle holes!," http://www.attictent.com/media/Scuttle_Hole_Access.htm, printed on Apr. 11, 2011, 1 page.

*Primary Examiner* — Phi A
(74) *Attorney, Agent, or Firm* — Lewis Rice LLC

(57) ABSTRACT

A cover for closing an access opening that leads to an infrequently used space within a building, such as an attic, that generally provides an air seal, thermal insulation and/or acoustic insulation at the access opening. The cover may be in one or two portions, including a closure alone or a closure and a frame having an aperture that can be closed by engagement between the closure and the frame. When the cover is used alone it engages a frame or a wall circumscribing the access opening. The cover is sized and shaped to close a stairwell, or the opening at one end of a stairway, an opening in a generally vertical wall, a hatch, or a pull down ladder. The closure and frame are each made of one or more components.

8 Claims, 25 Drawing Sheets

Related U.S. Application Data continuation-in-part of application No. 12/634,591, filed on Dec. 9, 2009, now Pat. No. 8,413,393, which is a continuation of application No. 10/024,478, filed on Dec. 21, 2001, now Pat. No. 7,650,722, application No. 14/880,969, which is a continuation-in-part of application No. 13/089,656, filed on Apr. 19, 2011, now Pat. No. 8,869,473, which is a continuation of application No. 12/768,593, filed on Apr. 27, 2010, now Pat. No. 7,926,229, which is a division of application No. 11/383,744, filed on May 16, 2006, now Pat. No. 7,849,644.

(60) Provisional application No. 60/681,309, filed on May 16, 2005.

(51) Int. Cl.

| | |
|---|---|
| ***E04F 11/06*** | (2006.01) |
| ***E04B 1/66*** | (2006.01) |
| ***E04B 1/74*** | (2006.01) |
| ***E04B 9/00*** | (2006.01) |
| ***E04F 19/08*** | (2006.01) |
| ***E06B 5/01*** | (2006.01) |
| *E04D 13/16* | (2006.01) |

(52) U.S. Cl.

CPC ..... *E04F 11/06* (2013.01); *E04F 19/08* (2013.01); *E06B 5/01* (2013.01); *E04B 1/76* (2013.01); *E04B 2001/742* (2013.01); *E04D 13/1618* (2013.01); *E04H 9/16* (2013.01)

(56) References Cited

U.S. PATENT DOCUMENTS

| | | | | |
|---|---|---|---|---|
| 794,661 | A | | 7/1905 | Clark |
| 947,063 | A | | 1/1910 | Hickman |
| 1,000,807 | A | | 8/1911 | Henry |
| 1,012,432 | A | | 12/1911 | Prendergast |
| 1,248,359 | A | | 11/1917 | McNulty |
| 1,380,831 | A | | 6/1921 | Nelson et al. |
| 1,411,331 | A | | 4/1922 | Elmore |
| 1,536,587 | A | | 5/1925 | Johnson |
| 1,630,100 | A | | 5/1927 | Whittier |
| 1,776,168 | A | | 9/1930 | Sweeley et al. |
| 1,936,631 | A | | 11/1933 | Lane |
| 1,958,487 | A | | 5/1934 | Moran |
| 1,989,391 | A | | 1/1935 | Whittier |
| 2,114,880 | A | | 4/1938 | King |
| 2,127,111 | A | | 8/1938 | Gaenzle |
| 2,172,373 | A | | 9/1939 | Flagstad |
| 2,190,954 | A | | 2/1940 | Stickel |
| 2,194,230 | A | | 3/1940 | Lewis |
| 2,210,580 | A | | 8/1940 | Gersten |
| 2,225,926 | A | | 12/1940 | Oelmann |
| 2,271,355 | A | | 1/1942 | Sweet |
| 2,275,128 | A | | 3/1942 | Campbell |
| 2,294,046 | A | | 8/1942 | Cser |
| 2,345,394 | A | | 3/1944 | Hogan |
| 2,511,108 | A | | 6/1950 | Hansen |
| 2,519,132 | A | | 8/1950 | Hansen |
| 2,652,787 | A | | 9/1953 | Keleher |
| 2,695,689 | A | | 11/1954 | Peterson |
| 2,747,202 | A | | 5/1956 | Driver |
| 2,793,721 | A | | 5/1957 | Sterud |
| 2,806,278 | A | | 9/1957 | Crump |
| 2,825,940 | A | | 3/1958 | Kurtz |
| 2,862,367 | A | | 12/1958 | Silverstein et al. |
| 2,908,947 | A | | 10/1959 | Meacham |
| 3,062,278 | A | | 11/1962 | Indorante |
| 3,120,032 | A | | 2/1964 | Bumette |
| 3,164,869 | A | | 1/1965 | Barkan |
| 3,243,855 | A | | 4/1966 | Houvener et al. |
| 3,252,258 | A | | 5/1966 | Blickman et al. |
| 3,283,386 | A | | 11/1966 | Cenegy |
| 3,356,183 | A | | 12/1967 | Shell |
| 3,361,286 | A | | 1/1968 | Alleaume |
| 3,397,490 | A | | 8/1968 | Carlson |
| 3,518,792 | A | | 7/1970 | Williamson et al. |
| 3,738,070 | A | | 6/1973 | Yarbrough |
| 3,797,172 | A | | 3/1974 | Cannon |
| 3,807,194 | A | * | 4/1974 | Bond ..... A47G 23/04 62/371 |
| 3,807,528 | A | | 4/1974 | Frank |
| 3,855,741 | A | | 12/1974 | Semon |
| 3,886,686 | A | | 6/1975 | Urbanick |
| 3,896,595 | A | | 7/1975 | Anghinetti et al. |
| 3,938,284 | A | | 2/1976 | Broadbent et al. |
| 3,967,671 | A | | 7/1976 | Stanley et al. |
| 4,048,926 | A | * | 9/1977 | Brush, Jr. ..... E05G 1/024 109/65 |
| 4,065,336 | A | | 12/1977 | Conklin |
| 4,084,570 | A | | 4/1978 | Rule et al. |
| 4,099,353 | A | | 7/1978 | Blunt |
| 4,118,894 | A | | 10/1978 | Kennedy et al. |
| 4,151,894 | A | | 5/1979 | Edwards |
| 4,180,142 | A | | 12/1979 | Sevillano et al. |
| 4,187,647 | A | | 2/1980 | Hall |
| 4,197,031 | A | * | 4/1980 | Hild ..... E02D 29/1409 210/163 |
| 4,203,686 | A | | 5/1980 | Bowman |
| 4,207,706 | A | | 6/1980 | Haines |
| 4,281,743 | A | | 8/1981 | Fuller |
| 4,299,059 | A | | 11/1981 | Smith |
| 4,302,126 | A | | 11/1981 | Fier |
| 4,312,423 | A | * | 1/1982 | Helbig ..... E04F 11/064 182/46 |
| 4,344,505 | A | | 8/1982 | Waters et al. |
| 4,361,613 | A | | 11/1982 | Bogner et al. |
| 4,370,934 | A | | 2/1983 | Haussler |
| 4,403,452 | A | | 9/1983 | Urbanick |
| 4,440,407 | A | | 4/1984 | Gagas |
| 4,468,886 | A | | 9/1984 | Tew |
| 4,469,087 | A | | 9/1984 | Cameron |
| 4,483,101 | A | | 11/1984 | Berzina |
| 4,502,368 | A | | 3/1985 | Hempel |
| 4,513,548 | A | | 4/1985 | Parker |
| 4,532,915 | A | * | 8/1985 | de Rham ..... F23J 13/08 126/242 |
| 4,541,508 | A | | 9/1985 | Lundh |
| 4,550,534 | A | | 11/1985 | Mariano et al. |
| 4,563,845 | A | | 1/1986 | Stipe |
| 4,567,074 | A | | 1/1986 | Litaker |
| 4,591,022 | A | | 5/1986 | Sciambi et al. |
| 4,650,534 | A | | 3/1987 | Mussi et al. |
| 4,658,555 | A | | 4/1987 | Steiner |
| 4,807,397 | A | | 2/1989 | Doan |
| 4,823,530 | A | | 4/1989 | Haring |
| 4,832,153 | A | | 5/1989 | Daw et al. |
| 4,890,418 | A | | 1/1990 | Sachs |
| 4,891,921 | A | | 1/1990 | Governale |
| 4,925,509 | A | | 5/1990 | Tippmann |
| 4,928,441 | A | | 5/1990 | Daley |
| 4,944,126 | A | | 7/1990 | King |
| 4,986,039 | A | | 1/1991 | Weisner |
| 5,007,226 | A | | 4/1991 | Nelson |
| 5,067,278 | A | | 11/1991 | Lyons |
| 5,158,043 | A | | 10/1992 | Emsbo |
| 5,161,329 | A | | 11/1992 | Brown |
| 5,172,519 | A | | 12/1992 | Cooper |
| 5,255,479 | A | | 10/1993 | Shepherd |
| 5,271,198 | A | | 12/1993 | Freeman |
| 5,301,655 | A | | 4/1994 | Licata |
| 5,361,552 | A | | 11/1994 | Fulford |
| 5,475,955 | A | | 12/1995 | Dickinson |
| 5,499,475 | A | | 3/1996 | Court et al. |
| 5,549,411 | A | | 8/1996 | Hawkins |
| 5,623,795 | A | | 4/1997 | Padgett, Jr. |
| 5,628,151 | A | * | 5/1997 | Monat ..... E04F 11/06 182/46 |
| 5,628,158 | A | | 5/1997 | Porter |
| 5,735,086 | A | | 4/1998 | Fordahl |
| 5,743,057 | A | | 4/1998 | Martin |

(56) References Cited

U.S. PATENT DOCUMENTS

| | | | |
|---|---|---|---|
| 5,791,098 | A | 8/1998 | Thomas |
| 5,815,996 | A | 10/1998 | Granger |
| 5,860,465 | A | 1/1999 | Eastridge et al. |
| 5,979,128 | A | 11/1999 | Parsons |
| 6,006,944 | A | 12/1999 | Machledt |
| 6,014,841 | A | 1/2000 | McCoy, Jr. et al. |
| 6,151,848 | A | 11/2000 | Hunter |
| 6,468,585 | B2 | 10/2002 | Tippmann et al. |
| 6,578,327 | B1 | 6/2003 | Hackbarth et al. |
| 6,581,876 | B2 | 6/2003 | Cheung |
| 6,601,352 | B1 | 8/2003 | Obermeyer et al. |
| 6,651,391 | B2 | 11/2003 | Nale |
| 6,658,803 | B2 | 12/2003 | Szyjkowski |
| 6,682,258 | B2 | 1/2004 | McNeely |
| 6,701,676 | B1 | 3/2004 | Kompelien |
| 6,739,100 | B1 | 5/2004 | Lewandowski |
| 6,848,492 | B2 | 2/2005 | Thomas |
| 7,028,431 | B2 | 4/2006 | Tlemcani et al. |
| D586,473 | S | 2/2009 | Copeland |
| 7,650,722 | B1 | 1/2010 | Melesky |
| 7,650,723 | B1 | 1/2010 | Kotlarich |
| 7,770,353 | B2 | 8/2010 | Olsen |
| 7,836,638 | B2 | 11/2010 | Ogieglo |
| 7,849,644 | B2 | 12/2010 | Melesky |
| 7,926,229 | B2 | 4/2011 | Melesky |
| 8,117,786 | B1 | 2/2012 | Tobbe |
| 2006/0064935 | A1 | 3/2006 | Smith et al. |
| 2007/0220826 | A1 | 9/2007 | Peng et al. |
| 2011/0225899 | A1 | 9/2011 | Melesky |

* cited by examiner

SYSTEMS AND METHODS FOR INSULATING ATTIC OPENINGS

CROSS REFERENCE TO RELATED APPLICATION(S)

This application is a Continuation of U.S. patent application Ser. No. 14/139,446 filed Dec. 23, 2013 and currently pending, which is in turn a Divisional of U.S. patent application Ser. No. 13/191,418 filed Jul. 26, 2011 and now U.S. Pat. No. 8,869,473, which is in turn a Continuation-in-Part (CIP) of U.S. patent application Ser. No. 12/634,591 filed Dec. 9, 2009 and now U.S. Pat. No. 8,413,393, which is in turn a continuation of U.S. patent application Ser. No. 10/024,478 filed Dec. 21, 2001, now U.S. Pat. No. 7,650,722. This application is also a Continuation-in-Part (CIP) of U.S. patent application Ser. No. 13/089,656, filed Apr. 19, 2011 and currently pending which is, in turn, a Continuation of U.S. patent application Ser. No. 12/768,593 filed Apr. 27, 2010, now U.S. Pat. No. 7,926,229, which is, in turn, a Divisional of U.S. patent application Ser. No. 11/383,744 filed May 16, 2006, now U.S. Pat. No. 7,849,644, which in turn claims benefit of U.S. Provisional Application Ser. No. 60/681,309 filed May 16, 2005. The entire disclosure of all the above references is herein incorporated by reference.

BACKGROUND OF THE INVENTION

1. Field of the Invention

This invention relates to covers used in wall or ceiling openings of buildings to inhibit loss of heat during cold weather and loss of cool air during hot weather and to provide air sealing of such entrances.

2. Description of the Related Art

Virtually every home has an attic to provide for insulation. Some homes have walk-through or crawl-through openings, some with doors (mounted in a generally vertical or horizontal orientation), for access to an attic space. When such an opening has a door, it may be an ordinary, full-sized door, mounted on hinges within a door frame, as are mounted most interior household doors. In other situations such a door may be as simple as a piece of plywood or other material that has been cut to fit into a wall or ceiling opening and which may be held in the opening by a latch, wing nuts, weather-stripping, or other fasteners, but often is not mounted on hinges. Other houses utilize attic entrances characterized by hatches (basically plywood or drywall covers for a ceiling hole) or pull down ladders which involve a hinged door or sliding structure with a collapsible ladder mounted thereon. Often such a door, whether full-sized or not, has no additional insulation within or about it, including not having any sort of weather-stripping around its edges, where it contacts the door frame or the wall. Such a door usually provides a substantial breach to the otherwise encompassing insulation of the home or other building. Further, such an existing door rarely can act as an air seal for the attic opening and can often allow for easy and significant air flow around its structure.

There have been a number of devices to date that have attempted to address this problem. The devices primarily address the problem with two main approaches, one- and two-piece covers.

There are a number of one-piece covers. U.S. Pat. No. 4,299,059 discloses a ceiling door that is insulated and to which an attic ladder is attached. U.S. Pat. No. 4,151,894 discloses a one-piece cover for an attic opening that fits over the attic door. It is double walled and able to contain a layer of insulation. U.S. Pat. No. 4,281,743 similarly provides a one-piece cover for an attic opening that fits over the attic door. This cover, however, is a shell, comprised of multiple pieces that need to be assembled in a tongue and groove design into which insulating panels are inserted. U.S. Pat. No. 5,475,955 discloses a two-piece shell that is able to contain insulation. U.S. Pat. No. 4,832,153 is also a one-piece cover for an attic opening. This cover consists of detachable components that can be stored or attached with assembly components to serve as an insulating cover. U.S. Pat. No. 4,928,441 discloses an inverted tub shaped cover that is hinged to an attic floor. U.S. Pat. No. 5,271,198 discloses a compartmentalized plastic or fiberboard shell with a moisture barrier insert that can accommodate insulation. U.S. Pat. No. 5,628,151 discloses a one-piece shell with multiple pockets that can hold insulation.

There have also been two-piece covers. U.S. Pat. No. 4,344,505 discloses a stationary frame with a hinged door that opens to an upright position. The door and frame are made of insulated material and covered with wood furring for securing the hinges to the door and frame. The door merely rests on the frame. U.S. Pat. No. 4,591,022 discloses a frame and door, but the door is in three pieces. In order to open the door, it collapses in an accordion manner to gain access to the attic. The frame consists of components that are attached and secured to the attic floor with hinges.

U.S. Pat. No. 4,312,423 discloses an all in one approach for a ladder, insulating cap and packaging container.

SUMMARY OF THE INVENTION

The following is a summary of the invention, which should provide to the reader a basic understanding of some aspects of the invention. This summary is not intended to identify critical elements of the invention or in any way to delineate the scope of the invention. The sole purpose of this summary is to present in simplified text some aspects of the invention as a prelude to the more detailed description presented below.

Described herein, among other things, are thermal insulation, air sealing, and/or acoustic insulating (e.g. sound dampening) covers for access openings to attics and other building spaces, which are not used regularly, e.g., spaces used for mid- to long-term storage rather than for frequent living or working activities. For convenience such spaces, which are separated from other parts of a building by a closure as described herein, may be referred to herein as storage spaces or attics, whether or not actually used for storage, since use as a storage space generally is one practical use for such infrequently used spaces. One such device is used in conjunction with access openings to a storage space at the top of a permanent stairwell or other structure utilizing a standard vertical door entrance at the lower end of the stairs and a ceiling opening to be insulated at the top of the stairs. Another device is used in conjunction with an opening in a vertical wall behind which is located the storage space (which is sometimes known as a "knee wall" opening). Other devices are for use with ceiling openings such as those that comprise simple ceiling hatches (or "scuttle holes") or those that comprise hatches which include pull down ladders to provide for easier access.

The covers for openings herein disclosed are intended to provide air sealing, thermal insulation, and/or acoustic insulation properties, and while this disclosure may refer to an embodiment having one or more of these properties, it should be recognized that any and all embodiments may have any or all of these properties. Similarly, while embodiments discussed here are made principally of material that is either thermally and/or acoustically insulating, this is by no means required and any material which provides none, any, or all of these properties which may be used. In an embodiment, the cover has one or more coatings, any of which may serve to protect it from wear, provide fire resistance, or provide greater thermal, air flow, or acoustic insulation. Additionally, the opening covers herein disclosed are preferably sufficiently lightweight so that men, women and youth can readily maneuver the devices.

A number of disclosed embodiments are designed to be lightweight and yet formed of insulating material that will provide for significant insulating value when the cover is placed into use. Because of the interfitting relationship of the closure member with the surfaces of an insulating frame or with a structural frame defining the opening, a generally air-tight seal is provided about the opening which further ensures significant thermal efficiency and reduction in noise transmission. A specific insulation performance, however, is not required for the devices disclosed herein.

Moreover, the essentially air-tight seal, itself, provides for both fire and mold prevention, regardless of any coatings that may be on the cover, because of the reduction in air flow into or out of the storage space. Particularly with regard to attics, the flow of warm moist air from inside the building into the attic can cause moisture build-up in the attic when the moisture in the warm air condenses on colder surfaces in the attic. The condensed moisture can cause numerous problems, including wood rot and mold growth. It can also exacerbate or cause ice damming in the gutters. Inhibition of air flow into the attic from other spaces in the building aids in inhibiting such problems caused by moisture in the attic.

Furthermore, a reduction in air flow into an attic space can aid in inhibiting fires. Since fire needs oxygen to continue, an air flow from an attic space into other parts of a building can help to fuel a fire in a living space, whereas when the air flow is inhibited the fire is also inhibited.

A first embodiment of an access cover as herein described comprises two components. A first component is a frame that rests in, on, or about the access opening and generally within the storage space. A second component is a closure that joins with the frame in such a manner as to create a snug fitting sealing connection. This two-component cover generally provides a insulating and air-sealing device that may have an insulating R-value similar to or greater than the rest of the insulation within and around the storage space. Additionally, the snug fit of the two components generally inhibits airflow therebetween and can act as an acoustic barrier. Gaps that allow air flow across an insulation barrier can allow energy loss and reduce the thermal and acoustic insulating properties of the barrier. Therefore, without such gaps, this cover provides an acoustically insulating device that inhibits sound transmission therethrough. The frame can also fill in existing gaps.

In an embodiment, both the closure and the frame can be moveable so as to provide the maximum flexibility for access through the opening, such as for moving relatively large objects therethrough. Alternatively, the frame is secured about the opening so as to be immoveable while the closure can separate from the frame. In a still further alternate, the closure and a section or sections of the frame are removable.

A second embodiment of the cover includes only the closure. Generally, this second embodiment is utilized in an opening that includes and is defined at least partially by an existing structural frame or opening in a floor to which the cover can be fitted similarly to the manner in which the closure is fitted to an insulating frame in a two-component cover. The frame of the opening to which a cover of this second embodiment may be joined may be made of any material, not necessarily a traditional insulating material; for instance such a frame may be a wood frame. In an embodiment, such a frame is either a roughed-in frame or a finished door frame. In an embodiment, the closure member includes a depending central portion of a size to fit within the frame that at least partially defines the access opening to the storage space. In alternate embodiments, the depending central portion fits within the frame of the access opening. The cover also generally includes a peripheral flange portion extending outwardly from the depending central portion so as to allow the closure to contact the upper surface of the structural frame (the surface furthest from the interior wall). In another embodiment, the closure does not include a flange portion, but is designed only to contact one surface about the frame.

There is described herein, in an embodiment, an insulating cover assembly comprising: a continuous frame having spaced side walls and spaced end walls, the frame defining a frame opening therethrough; a removable closure member, the removable closure member including: a depending central portion, the depending central portion being sized and shaped to fit within the frame opening when the removable closure member is positioned on the frame in a covering relationship with respect to the frame opening; and an upper portion forming flanges, the flanges extending laterally outward relative to the depending central portion, the flanges being sized and shaped to engage an upper surface of each of the side walls and end walls to create a continuous seal with the frame when the removable closure member is positioned on the frame in covering relationship with respect to the opening defined by the frame; wherein the closure member is completely detached from the frame when the continuous seal is broken.

In an embodiment of the cover the depending central portion engages the side walls of the frame inside the frame opening to create a first continuous seal with the side walls when the removable closure member is positioned on the frame in a covering relationship with respect to the frame opening.

In another embodiment of the cover the depending central portion engages the end walls of the frame inside the frame opening to create a first continuous seal with the end walls when the removable closure member is positioned on the frame in a covering relationship with respect to the frame opening.

In another embodiment of the cover ends of the flanges extend beyond the outer perimeter of the frame when the removable closure member is positioned on the frame in covering relationship with respect to the opening defined by the frame. This cover may further comprise a downward extending border extending from the flanges in the same direction as the depending portion, the downward extending border being adjacent the outer perimeter of the frame. The downward extending border may engage the side walls and the end walls of the frame along the outer perimeter of the frame to create a second continuous seal with the side walls and the end walls when the removable closure member is positioned on the frame in a covering relationship with respect to the frame opening. The depending central portion's engagement of the side walls and the end walls of the frame inside the frame opening may create a third continuous seal with the side walls and the ends walls when the removable closure member is positioned on the frame in a covering relationship with respect to the frame opening.

Alternatively, the depending central portion may engage the side walls and the end walls of the frame inside the frame opening to create a second continuous seal with the side walls and the ends walls when the removable closure member is positioned on the frame in a covering relationship with respect to the frame opening.

In another embodiment the cover further comprises at least one, or at least two, elongated tab(s) extending generally perpendicularly from the plane of the frame. The elongated tab(s) extend from the opposing side walls or the opposing ends walls, may be arranged in line with at least one of the side walls or ends walls, or may be arranged not in line with at least one of the side walls or ends walls, such as being arranged adjacent with at least one of the side walls or ends walls.

In another embodiment of the cover the elongated tab(s) are sized and shaped to extend between framing joists of a building. The frame may be sized and shaped to be larger that a structural frame surrounding an access opening in a building. The tab(s) and the framing joists, in combination, serve to encapsulate the access opening or the structural frame.

In another embodiment, the cover is sized and shaped to be positioned over an access opening positioned in a vertical wall of a building or over an access opening in a horizontal ceiling of a building.

In another embodiment the flanges and upper surfaces of the frame of the cover include mating male and female connectors. The flanges or the upper surfaces may include the male connectors. The connectors may be arranged continuously over the flanges and the upper surfaces or in discrete areas of the flanges and the upper surfaces such as, but not limited to, being on only the end walls or the side walls.

DETAILED DESCRIPTION OF THE PREFERRED EMBODIMENT(S)

Although the present invention will be described hereinafter with particular reference to the accompanying drawings, it is to be understood at the outset that it is contemplated that the present invention may be varied in specific detail from that illustrated and described herein while still achieving the desirable characteristics and features of the present invention. Further, while specific frames, closures, and other components and features of the covers are depicted in specific embodiments for use with hatches, pull-down ladders, knee walls, or stairways, it should be understood that these components and features can be used across covers for use in the various different types of use. Accordingly, the description that follows is intended to be understood as a broad enabling disclosure directed to persons skilled in the applicable arts, and is not to be understood as being restrictive.

Figure 1:
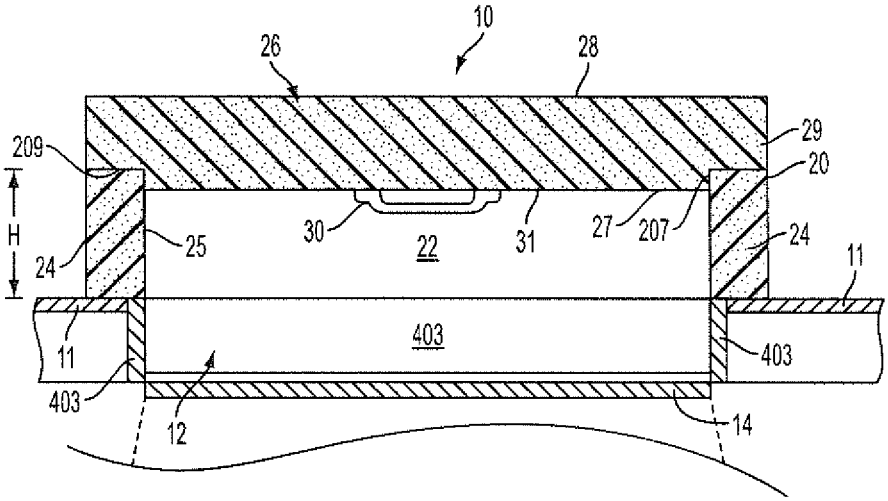
FIG. 1 is a cross sectional view of a first embodiment of an insulating cover showing the insulating cover mounted above a stairway to an upper level storage space.

A first embodiment of a cover is disclosed in FIG. 1, which provides a cross-sectional view of an insulated cover (10) for an opening to a storage space. The cover (10) comprises a closure (26) and a frame (20), each of which may further comprise sub-portions or components. As shown in FIG. 1, the frame (20) of this embodiment is mounted so as to rest on a floor (11) of the storage space, in surrounding relationship with respect to the opening (12), which is closed by a hatch (14). The cover (10) includes an open frame (20) having side walls (22) and end walls (24). In the embodiment shown, the frame (20) is generally rectangular or square in configuration, though in alternate embodiments the frame (20) can take any shape, and particularly has a shape so as to allow the frame (20) to have a surrounding relationship with the opening (12). The height "H" of the walls of the frame (20) is sufficient that the upper edge of the frame extends above any ladder (15) (such as is shown in FIG. 2) that may be positioned within the access opening (12). Additionally, in an embodiment, the height H of the frame (20) allows for easier opening of the closure (26) as a person reaching upwards through the opening (12) has more head room.

The frame (20) preferably has a circumference or perimeter dimension of a size and shape at least equal to the size and shape of the perimeter of the opening (12) at the floor (11) of the storage space, so as not to interfere with the access opening (12), as shown in FIG. 1—an example of a surrounding relationship. While the frame (20) is generally depicted as being rectangular, one of ordinary skill would understand that it can have any shape including other parallelograms, other polygons, circles, or curving shapes. In alternate embodiments, the surrounding relationship of the frame (20) to the opening (12) includes that the frame (20) encroaches into the access opening (12), or has a shape and size larger than those of the opening (12). The frame (20) is designed such that it may simply rest on the floor of the storage space; however, in an embodiment, the frame (20) may be secured to the floor, floor joists, structural framing or other components.

In an alternative embodiment, the frame (20) may be partially secured to the floor (11) to allow one or more section(s) to pull out. For example, the two side walls (22) and one end wall (24) may be secured to the floor, while the other end wall (24) is not, allowing the unsecured end wall (24) to be lifted out to improve access through the frame (20). In such an embodiment, the end wall (24) may simply be positioned loosely or it may be attached to the side walls (22) in an interlocking manner by a separable connector such as, but not limited to, the connectors shown in FIGS. 8-12 (which may also be used to secure frame components not designed to be removable), so that it is held in position when placed in the frame (20) but can be removed once the cover is taken off. This will generally be a temporary connection designed to be repeatedly removable. In a still further embodiment, the end wall (24) may be hinged or otherwise moveably attached to the rest of the frame (20) to provide the same purpose.

Figure 22:
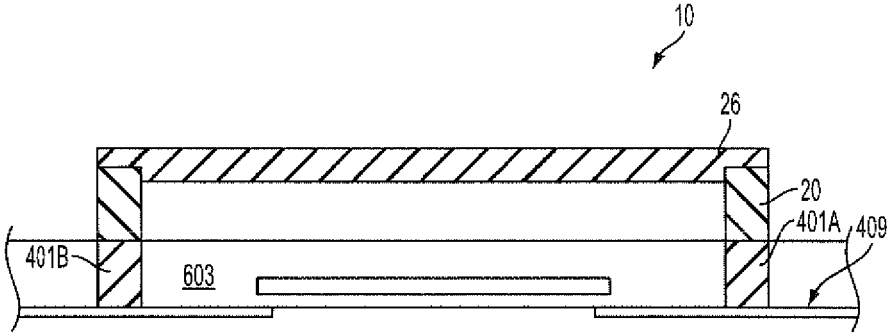
FIG. 22 provides a side cut-through view of a cover where the frame includes elongated tabs in place over an attic hatch opening where the device is larger in its dimension than the hatch framing.
Figure 23:
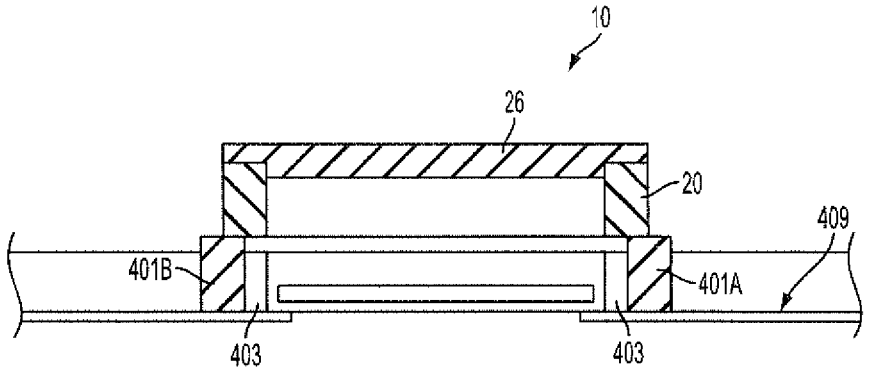
FIG. 23 provides a side cut-through view of a cover in place on an attic hatch where the elongated tabs are offset to position them outside of a hatch frame.
Figure 24:
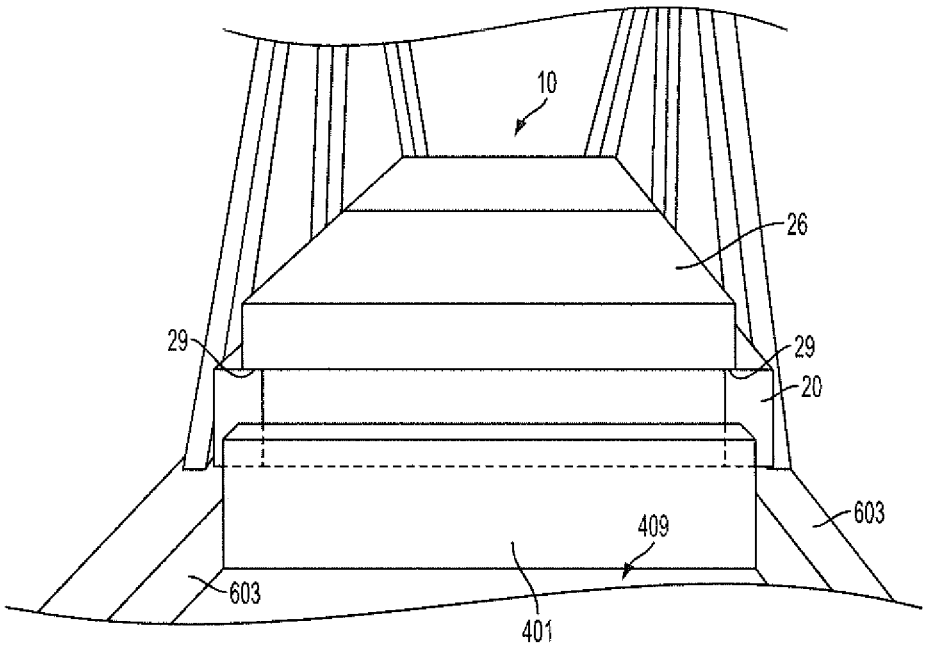
FIG. 24 shows an end on view of a cover in place on an attic hatch where the elongated tabs are positioned outside of the cover's insulating frame to allow use of a fixed cover size and fixed size tabs in a variety of installations.

In the embodiments depicted in FIGS. 22-24, the frame (20) is modified to include elongated "tabs" (401) which are designed to provide for an interface between the frame (20) and the opening (12) in the event that the opening (12) does not include a floor (11). The various embodiments of these FIGS. may or may not include a complete structural frame (403) surrounding the opening (12). These embodiments are discussed in greater detail later in this disclosure, but are indicated here simply to show that the frame (20) of FIG. 1 may interact with or rest on the enclosing structural frame (403) even if the floor (11) is not present.

in an embodiment, the frame (20) and/or the closure (26) may be made of lightweight, dense, insulating, man-made board such as, but not limited to, an expanded polystyrene material. In alternate embodiments, the material from which the cover (10) is made may be any material such as, but not limited to, plastics, wood, metals, composites, and combinations thereof, but preferably is a material that when all the pieces of the cover (10) are fit snuggly together and used to snuggly close an access opening, it provides a substantial thermal, air, and/or acoustic barrier, so as to inhibit the loss of cool air from the more commonly used spaces within the building when the ambient temperature (outside the building) is warmer than desired inside the commonly used spaces, and to inhibit the loss of warm air from the more commonly used spaces when the ambient weather (outside the building) is cooler than desired inside the commonly used spaces.

In the embodiment of FIG. 1, the closure (26) includes a depending central portion (27) which depends below or extends downwardly relative to an upper portion (28) to which the depending central portion (27) is attached. From the upper portion (28) there also extends laterally a flange portion (29) which is effectively a part of the upper portion (28) in FIG. 1. The depending central portion (27) is specifically designed to fit within an area internal to and defined by the frame (20), as shown in FIG. 1, and/or the opening (12). The depending central portion (27) is preferably sized and shaped smaller than the size and shape of the internal walls (25) within the frame (20). In an embodiment the depending central portion (27) is of a size and shape to snugly and frictionally engage with the inner wall (25) of the frame at a first seal (207). However, in an alternative embodiment, the depending central portion (27) is sized and shaped to fit within the inner wall (25) of the frame (12) and does not snuggly engage on all sides. In different embodiments, this fit may be such that the depending central portion (27) engages no sides, or it may be the case that the depending central portion engages a subset of sides such as snuggly engaging only the opposing sides of the frame (20).

The flange portion (29) extends outwardly from the depending central portion (27), and is designed to engage the upper surface of the frame (20) when the depending central portion (27) is positioned within the internal opening of the frame (20), thereby creating a seal (209). In an embodiment, the flange portion (29) has a dimension such that the outer edges thereof come into general alignment with the outer edges of the frame (20) so that the flange portion (29) of the closure (26) does not significantly extend beyond the external periphery of the frame (20), as shown in FIG. 1. However, in alternative embodiments, such as those shown in FIGS. 27-32, the flange portion (29) extends beyond the outer edges of the frame (20). The interfitting relationship between the closure (26) and the frame (20) of FIG. 1 forms a generally "L-shaped" seal, the shape of which helps to inhibit air from passing between the closure (26) and the frame (20), when the closure (26) and frame (20) are engaged, as shown in FIG. 1, thereby providing high thermal efficiency when in use, as well as reducing the passing of noise and air through the access opening.

In the event that the depending central portion (27) is smaller than the perimeter of the inner walls (25) of the frame (20), there will generally be at most a seal (207) formed on a subset of the interior walls (25) due to snug fit not existing at other points. In this case, the seal (209) will be formed between the flange portion (29) and the top of the frame (20) and will be the only seal. This single seal (209) will still extend the entire periphery of the arrangement when the closure (26) is positioned on the frame (20). Also, depending on embodiment, the "L-shaped" seal (formed from seal (209) and (207) in combination) may still be formed on two opposing interior walls (25) while the other two opposing interior walls (25) have only the seal (209) between the flange portion (29) and the top of the frame (20) being formed. These single seal (209), or combination single (209) and partial double (207) and (209) seal embodiments, can be particularly useful where the opening (12) which is to be sealed is of non standard shape. Specifically, the frame (20) can be designed to have one or more variable horizontal dimensions. This arrangement allows for the cover to be used on a variety of different sized openings. Specifically, the size of a hatch or pull-down ladder opening (12) is often fixed in one dimension (due to the necessary positioning of floor and roofing joists (403)) but is often variable in the other dimension. Therefore, the frame (20) may be placed on the structural frame elements (403) or floor (11) but it may be necessary to make the frame (20) longer in one dimension to reach them.

In the event that the closure (26) and frame (20) only form an "L-shaped" seal on fewer than all the sides, the protrusion (27), however, is still useful. Specifically, the protrusion (27) may form a portion of the "L-shaped" seal on the remaining sides, and/or may also be used to assist in correctly positioning the closure (26) on the frame (20). Specifically, because the protrusion (27) is smaller than the frame (20) opening, the protrusion (27) will still need to be positioned within the volume defined by the interior walls (25) to correctly position the closure (26). Thus, the seal (209) between the flange (29) and the top of the frame (20) is much more easily verified. Thus, the ability of the protrusion (27) to be positioned within the inner walls (25) helps the user to verify that the closure (26) has been correctly positioned on the frame (20) and the cover (10) is closed even if the protrusion (27) does not seal to the walls (25).

In a still further embodiment, the upper surface of the frame (20) can include a protrusion or recession in the form of a male or female connector which is designed to mate with an opposing connector on the underside of the flange (29). These can comprise connectors such as those shown in FIGS. 9-11, for example, and may be continuous on the upper surface of the frame (20) (e.g. forming a channel) or may be formed at discrete areas (e.g. on only two sides, or as a series of columns). In these embodiments, the first seal (209) would not comprise a single seal, but would actually comprise multiple interconnected or distinct seals. Further, such a mating connector arrangement could also serve to assist in correctly positioning the closure (26) on the frame (20).

Figure 4:
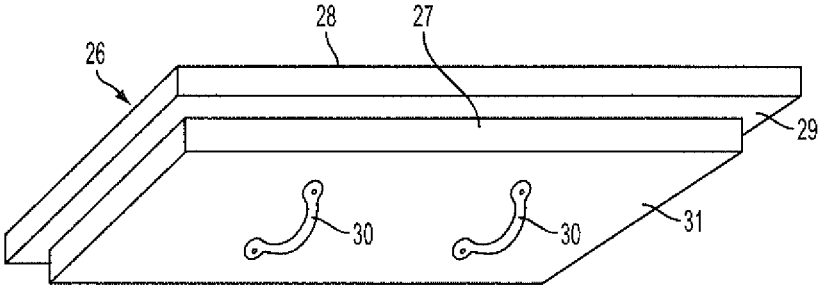
FIG. 4 shows a perspective view of the closure member of FIG. 1.

As shown in FIG. 4, one or more handles (30) may be provided on the closure (26), which extend from the lower surface (31) of the depending central portion (27) of the closure (26). The handle or handles (30) may be used to aid a person to engage or disengage the closure (26) with the frame (20), such as for moving the closure (26) away from the opening (12) to allow access to the storage space.

Figure 2A:
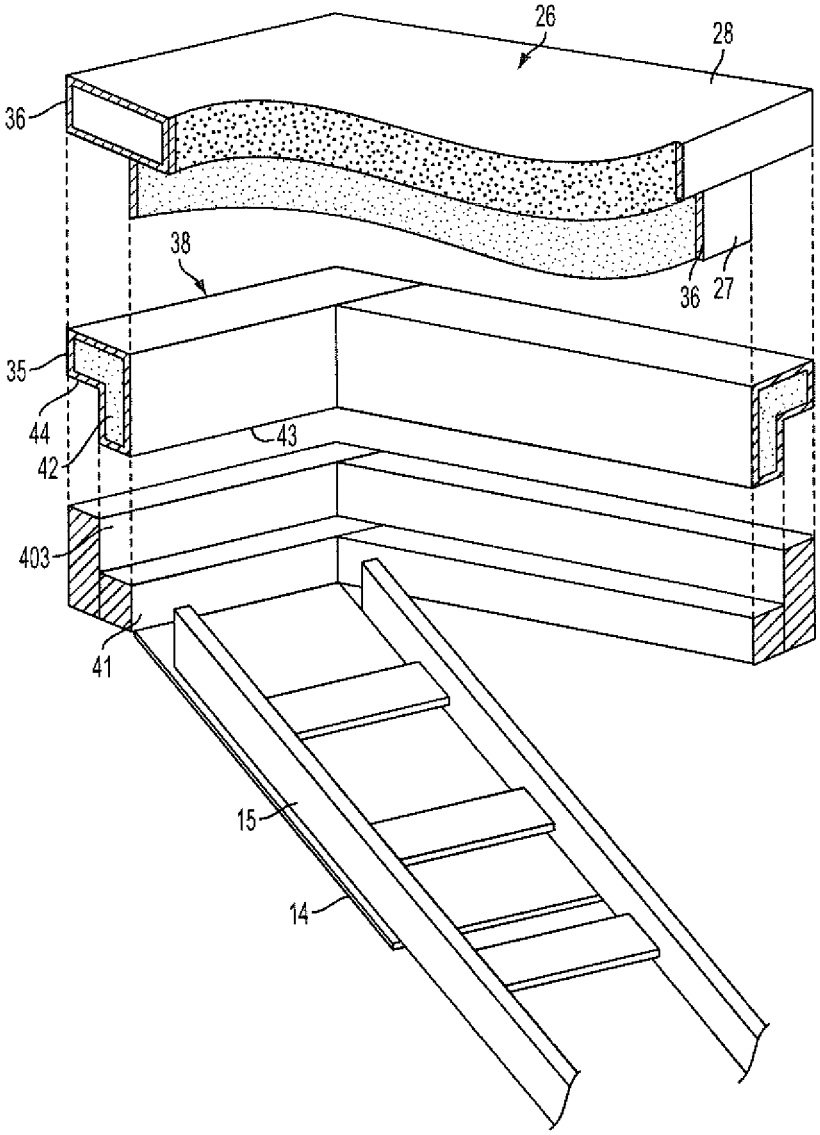
FIG. 2A is a perspective view showing an alternate embodiment of the insulating cover having an insulating frame with both a depending flange portion and a laterally extending flange portion.
Figure 2B:
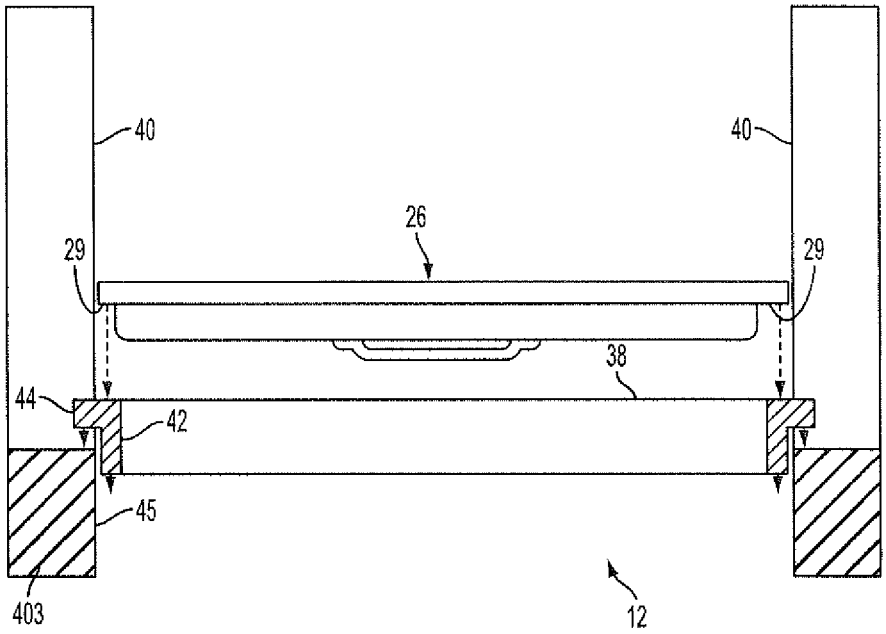
FIG. 2B is a cross sectional view of an embodiment such as shown in FIG. 2A, though wherein the opening frame is supported by vertical support trusses.
Figure 3:
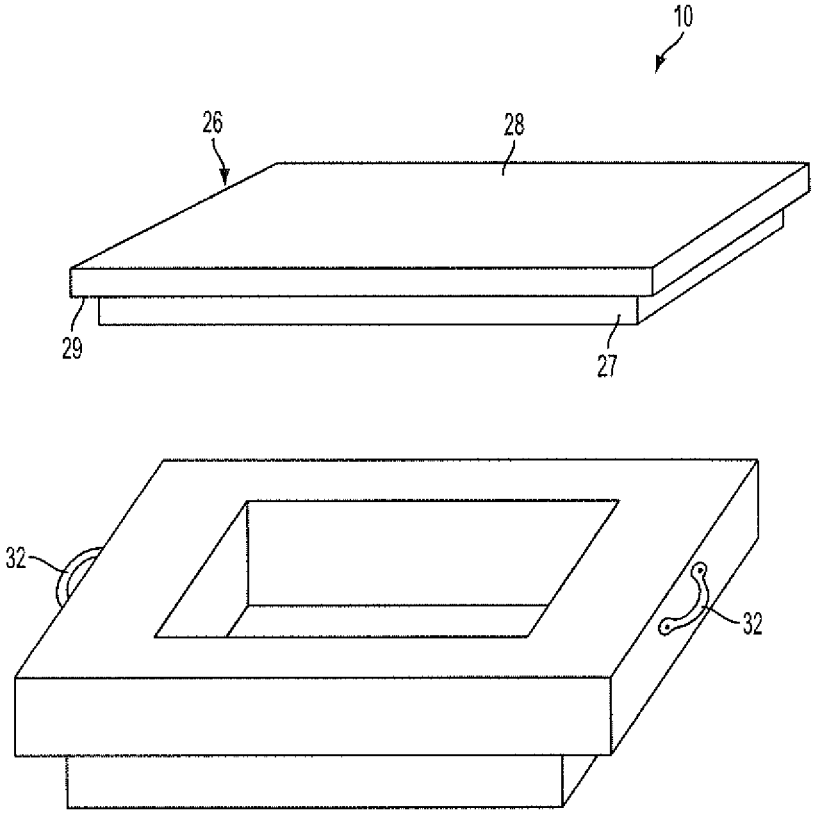
FIG. 3 shows a perspective view of a cover as shown in FIGS. 2A and 2B.

FIGS. 2A-3 show another embodiment in which the closure (26) is the same as that shown in and described with respect to FIGS. 1 and 3 and is sized and shaped to be placed on a ceiling hatch (14) having a drop-down ladder (15). In this embodiment, however, the insulating frame (38) is designed to be seated partially within a structural frame (403), which defines the opening (12) into the storage space. In alternate embodiments, structural frame (403) is either exposed roughed-in framing material used in constructing the access opening (12) or may be a finish material such as a finish frame. In a further embodiment, the structural frame (403) may be connected to or suspended from vertical support trusses (40). In these instances the frame (38) must fit with the structural frame (403) without interference with the trusses (40).

The insulating frame (38) of this embodiment is formed with an inner depending flange (42). The shape and size of the frame (38) with flange (42) allows the flange (42) to contact the inner sides 45 of the structural frame (403) and to frictionally engage therewith when the flange (42) is positioned within the access opening. With this insulating frame (38) structure, the upper and outer portion of the frame (38) may also be considered a flange (44), which is positioned in surrounding relationship to the access opening (12), extending around the periphery thereof, and which either seals against the upper portion of the structural frame (403) or seals against the floor (11). In this embodiment, as shown in FIGS. 2A-3, the materials of the frame (38) and closure (26), as well as the manner in which the closure (26) seals with respect to the frame (38) is essentially the same as that previously described with respect to FIG. 1.

In an alternative embodiment, the structure of FIGS. 2A-3 may be used where the flange rests against the trusses and/or floor joists. In such an embodiment, the closure (26) will generally be smaller in one or more dimensions than the frame (38) so that the flange portions (29) do not extend to the outer perimeter of the frame (38), as is shown in FIG. 23. Such designs can allow for improved maneuverability of the closure (26) in tight spaces and provide for easier clearance of objects in the attic space. While such improved maneuverability can be clearly valuable when trusses are present, one of ordinary skill would appreciate that it can be used with any cover (10) in any attic arrangement.

As shown in FIG. 3 with respect to a frame (20) of an embodiment as shown in FIG. 2, to facilitate maneuvering of the frame, when the frame (38) is moveable and not secured about the opening (12), handles (32) may be secured to one or more side walls thereof, either inside the aperture of the frame (38) or outside the frame (38), as shown.

Further, to provide for safety, ease of assembly and durability, in an embodiment, the pieces of the cover (10) may be sealed with a sealant. In an alternate embodiment, the pieces of the cover (10) are coated with a fireproof material. The fire retardant coated layers are preferably an elastomeric resin. The fireproof or retardant coating may be paints or sealants which meet fire hazard classifications ASTM E-84 (NFPA 255) Class A. One such product is FIRESHELL™ F10E made by TPR$^2$ Corporation.

Figure 5:
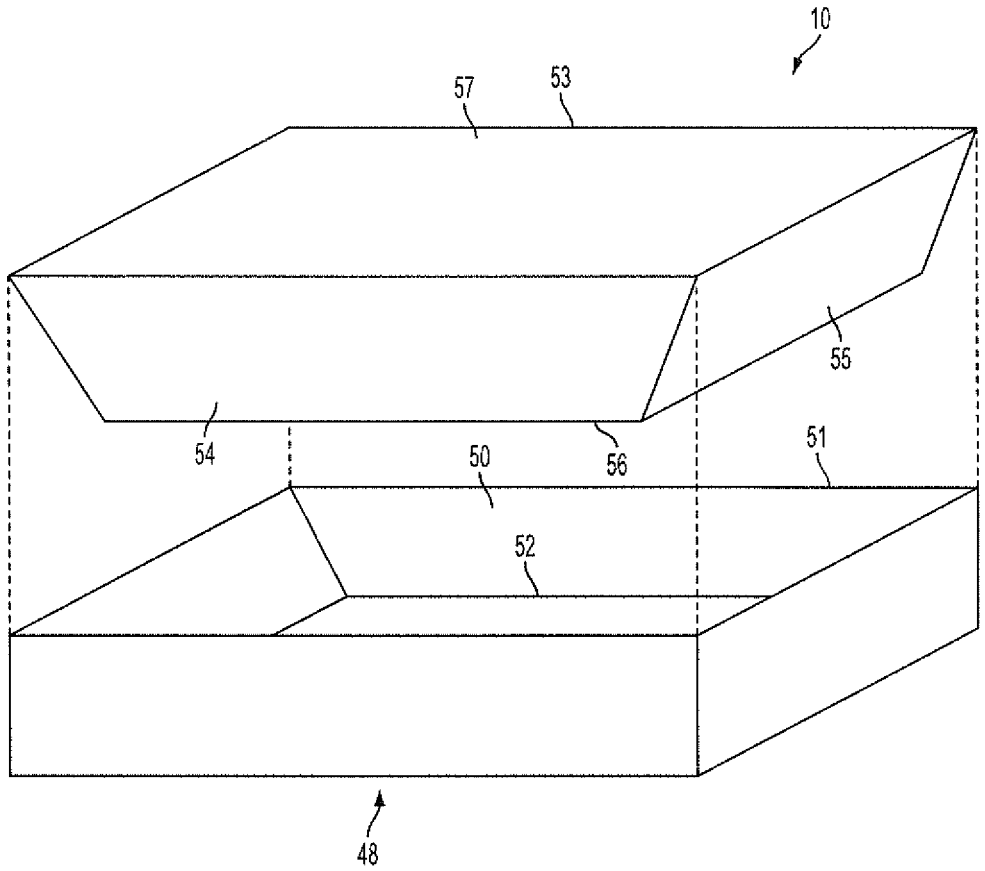
FIG. 5 is a perspective assembly view of an alternate embodiment of an insulating cover having a beveled seal.

Another embodiment is shown in FIG. 5. As opposed to the cover (10) of FIG. 1, having the closure (26) and frame (20) configured to form a generally L-shape seal area, the frame (48) of the embodiment shown in FIG. 5 is formed having internally beveled surfaces (50) which extend inwardly from upper edges (51) toward lower edges (52) thereof such that the inner side walls (50) taper inwardly from the top to the bottom of the frame (48). A closure member (53) includes opposite side walls (54) and opposite end walls (55) each of which is beveled inwardly from the top (57) toward the bottom (56) of the closure member. The configurations of the beveled surfaces are designed such that the closure member (53) seats and seals through frictional engagement with the side walls (54) and (55) thereof against the tapered side walls (50) of the frame (48). The material used in this embodiment may be any of the material previously described with respect to FIG. 1. Although, not shown in FIG. 5, appropriate handles may also be provided on the frame (48) and on the closure member (53) (as shown in FIGS. 3 and 4) to facilitate maneuvering of each component when necessary.

In still further embodiments, the seal between the closure member (26) or (53) and the frame (20), (38) or (48), respectively for FIGS. 1 through 5, is some combination of the seals of the embodiments shown in these FIGS., such as where the depending central portion (27) of the embodiment shown in FIG. 1 seats into the frame (20), (38) or (48) along a beveled seal.

Figure 27:
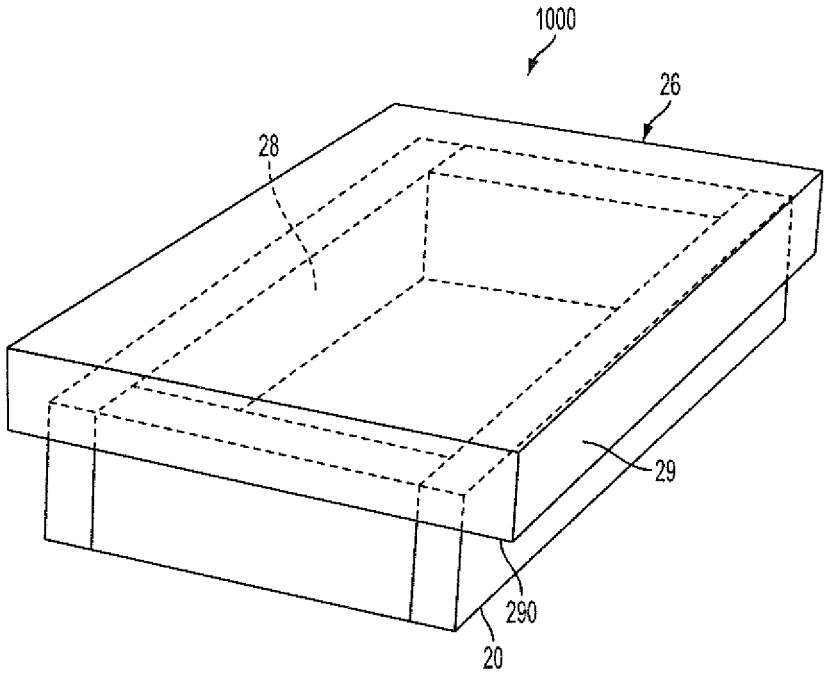
FIG. 27 shows a perspective view of a triple "U" seal cover.
Figure 28:
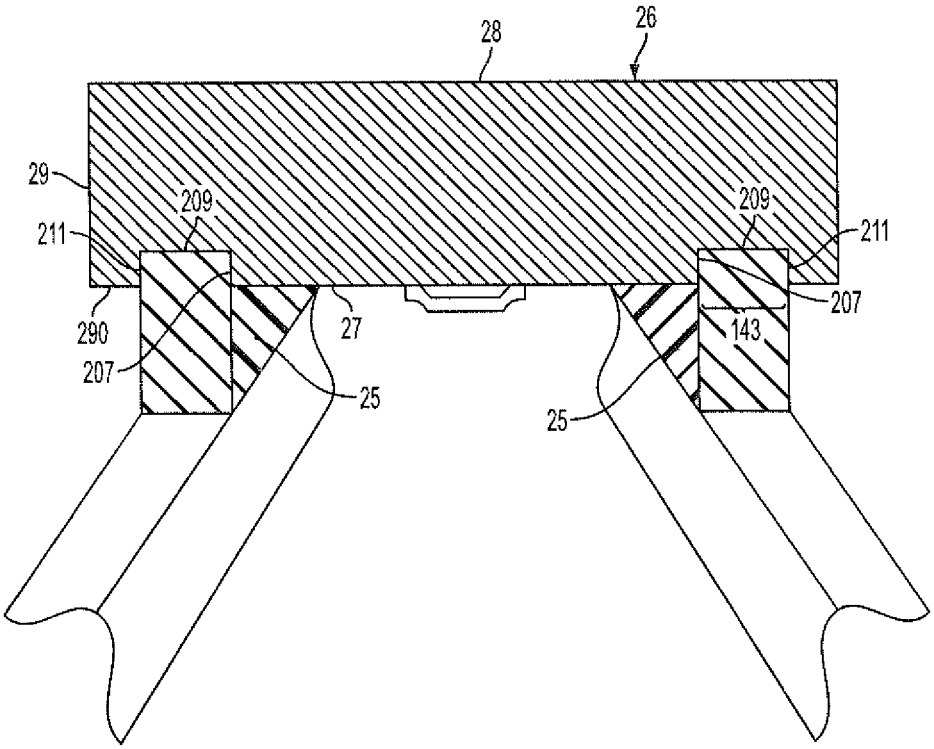
FIG. 28 shows a cutaway view of a cover of FIG. 27 in place over a ceiling hatch or pull-down ladder.
Figure 29:
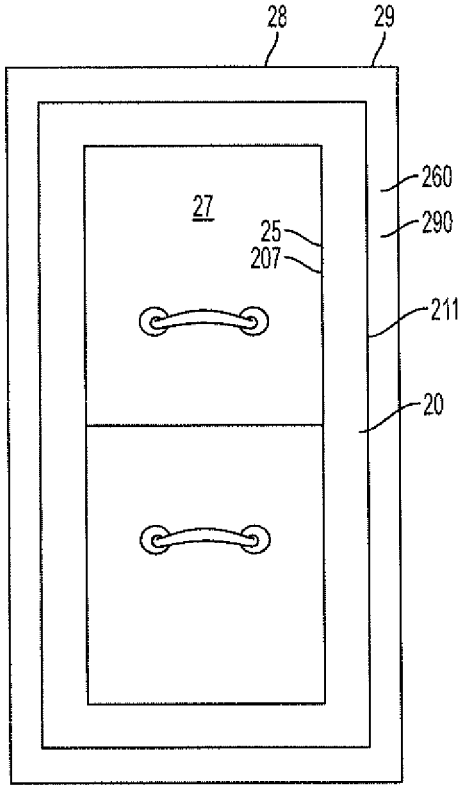
FIG. 29 provides a bottom view of a cover of FIG. 27 utilizing a triple seal which includes the sections which can be separately removed.

FIGS. 27-29 provide for another alternative method for sealing the closure member (260) to the frame (20). In the embodiment of these FIGS., the frame (20) is substantially similar to that at FIG. 1. However, the closure member (260) is modified so that a "U" shaped seal or triple seal is formed between the closure member (260) and frame (20). Specifically, the frame (20) has generally the same shape and designs as the frame (20) of the previously discussed embodiments of FIGS. 1 through 5. The closure member (26), however, includes an additional component. There is still the upper portion (28) with flanges (29) and the depending central portion (27). However, the flanges (29) are arranged to extend further from the depending central portion (27) so as to extend beyond the outer perimeter of the frame (20). The ends of the flanges (29) then include a downward extending border (290) adjacent the outer perimeter of the frame (20) which downward extending border (290) extends from the closure member (26) in the same direction as the depending central portion (27). This creates a channel (143) on one of the major surfaces of the closure member (26) which generally corresponds to the shape of major dimension of the frame (20). In the depicted embodiment, the border (290) is arranged at the periphery of the flange (29) but this is by no means necessary and the border (290) may be arranged internal to the perimeter of the flanges (29).

As should be apparent, the border (290) serves to provide a depending area on the outside of the frame (20), while the depending central portion (27) provides a depending portion on the inside of the frame (20). In the embodiment of FIGS. 27-29, these portions serve to create a U-shaped or triple seal with the frame (20). Specifically there is a first seal formed between the depending central portion (27) and the inner surface (25) of the frame (20), a second seal formed between the bottom of the flange (29) and the top surface of the frame (20), and a third seal (211) formed between the inner surface of the border (260) and the exterior surface of the frame (20). This can provide for even greater sealing between the frame (20) and closure member (26) than the L-shaped seal discussed in conjunction with FIG. 1.

Figure 30:
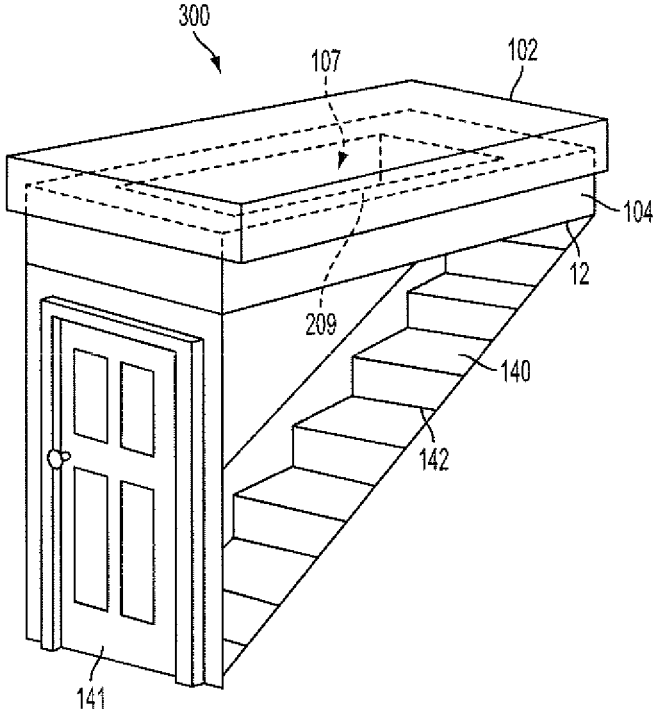
FIG. 30 shows a perspective view of a cover for use in a stairwell opening which utilizes a triple seal.
Figure 31:
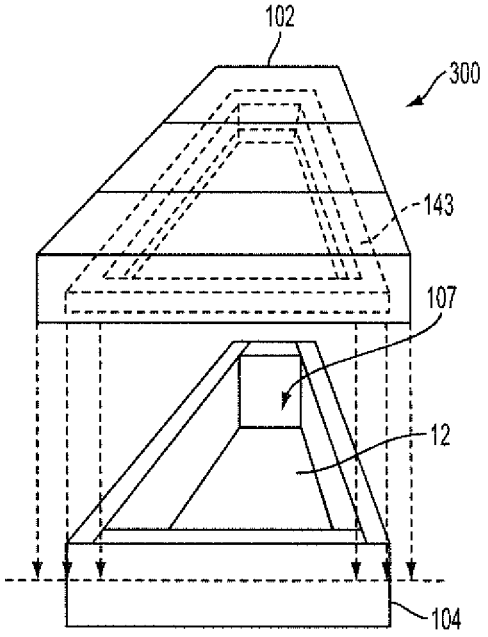
FIG. 31 provides an alternative view of the cover of FIG. 29 apart from its environment of use.
Figure 32:
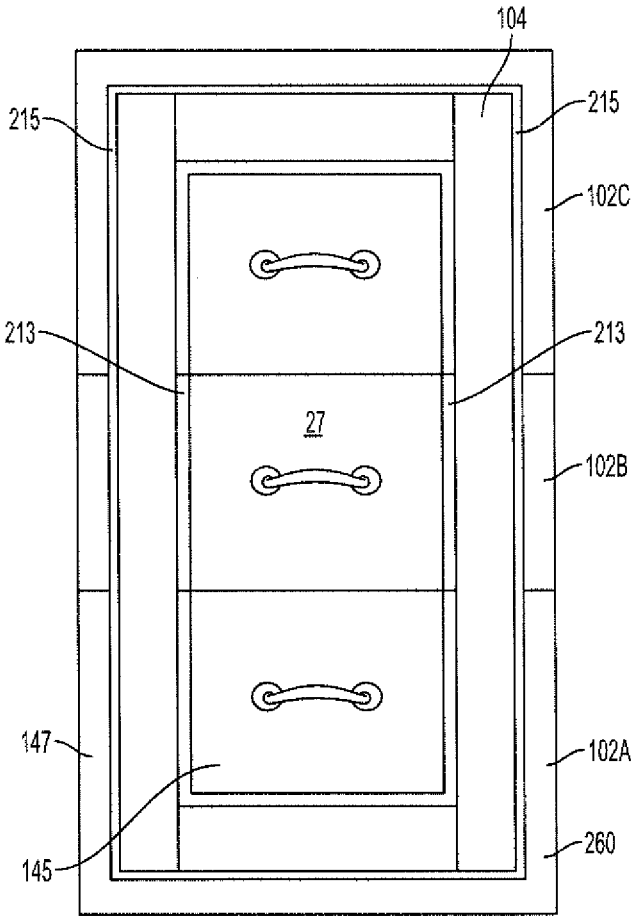
FIG. 32 provides a bottom view of a cover of FIG. 30 utilizing a channel but single seal which includes sections which can be separately opened.

In the embodiment, shown in FIG. 32, a similar structure of the closure member (26) is provided as in FIGS. 27-29 (although sized for the stairway embodiment of FIGS. 30-31). However, the full three seals (207), (209), and (211) are not formed. Instead, in this embodiment, there are gaps (213) and (215) provided between the depending portion (27) and the inner surface (25) of the frame (20) and between the inner surface of the border (260) and the exterior surface of the frame (20). In this embodiment, there is only a single seal (209) formed. This is the generally horizontal seal formed between the underside of the flange (20) and the top of the frame (20).

This single seal (209) embodiment of FIG. 32 still utilizes the depending portion (27) and border (260) to provide other functionality. Specifically, the depending portion (27) and border (260) serve to provide for alignment and positioning of the closure member (102) over the frame (20). As should be apparent from Examination of the FIGS., having a channel (143) formed in the closure member (102) provides that the closure member (102) will seat down on the frame (104) when the frame (104) is positioned in the channel (143) as shown in FIGS. 29 and 32. This provides that a user, lowering the closure member (102) onto the frame (104) as shown in FIG. 30, will be able to correctly align and position the closure member (102) on the frame (104). When the closure member (102) and frame (104) are correctly aligned, the closure member (102) will "seat" downward forming the seal (209). As should be apparent, when the closure member (102) and frame (104) are seated correctly, the seal (209) (between the lower surface of the flange (29) and the upper surface of the frame (104) will be provided. Thus, the channel (143) can serve to improve the likelihood of a good seal (209) being formed. Still further, the existence of the depending border (260) and depending portion (27) can also serve to provide a tortuous air path about the seal (209). This can provide for further sealing qualities over a seal (209) between two planar pieces, even without the other two seals (207) and (211) being formed.

In a still further embodiment, the design of FIGS. 27-29 may be used on any of the different covers discussed herein, however, only two of the three seals (207), (209) and (211) provided may be present. This can be any combination of seals and may change depending on the size of the device (10) being constructed. This type of arrangement can be useful in certain situations where the cover (10) may need to have specific cutouts or be modified so as to be positionable within existing building structures.

Figure 6:
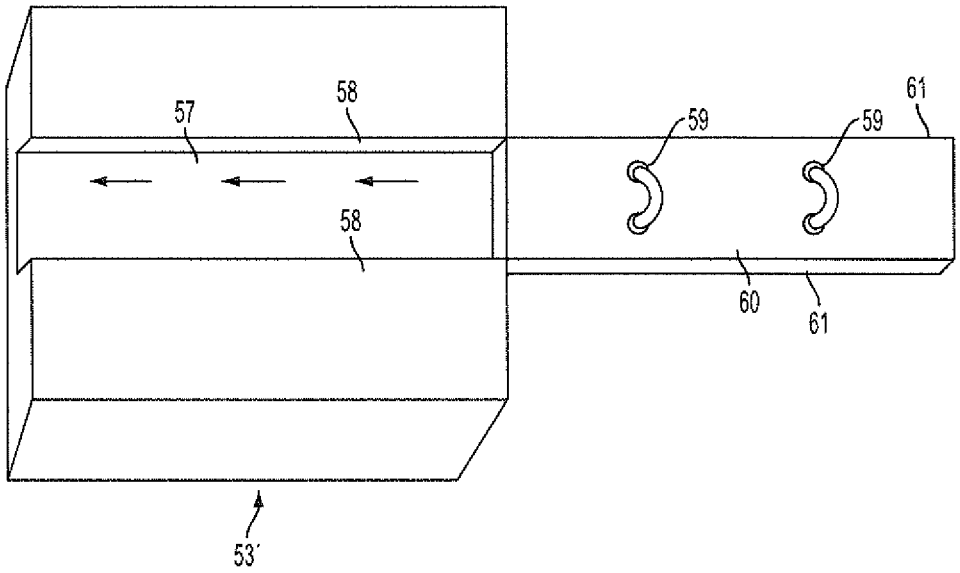
FIG. 6 is a perspective assembly view of a manner of securing handles to a closure member.

With specific reference to FIG. 6, a manner of securing handles to various embodiments is shown. A closure member (53') similar to that shown in FIG. 5, is shown as including a groove or channel (57) formed therein defined by undercut or beveled opposing edges (58). In an embodiment, the channel (57) is formed during formation of the closure (53'). Handles (59) are secured by mechanical fasteners to a slide strip (60) constructed of wood, plastic or metal, which is mechanically able to retain the fasteners without fracturing or otherwise becoming damaged under typical use. The side edges (61) of the strip (60) are beveled to interlock within the channel edges (58) by sliding the strip (61) into the channel (57), as shown by the arrows in FIG. 6. In an embodiment, glue or other adhesive is used to secure the strip (61) to the closure member (53'), while in some embodiments no adhesive is used. This manner of securing the handles (59) is useful in some embodiments, since the material from which the closure members (53') and frames (48) are constructed may be subject to material failure as a result of the forces applied thereto by use of the handles (59) in the expected manner (i.e., for lifting and moving the portions of the closure (53').

Figure 7A:
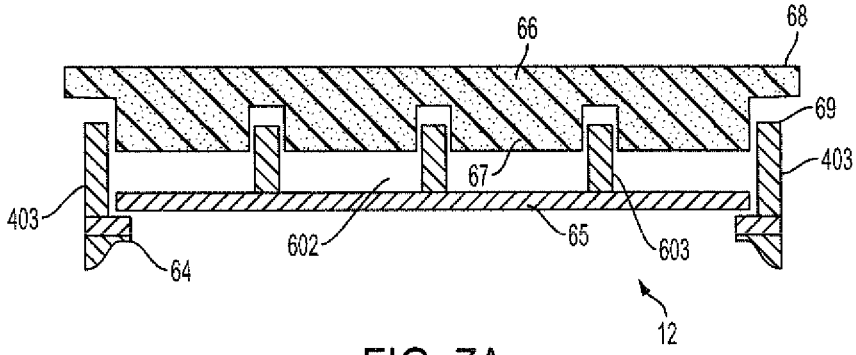
FIG. 7A is a cross-sectional view of an embodiment of a closure wherein extending body portions for the purpose of sealing channels left open in an access opening that does not have a complete opening frame.

With reference to FIG. 7A, another embodiment of the invention is disclosed. This embodiment is particularly suited for use with access openings that are defined by structural or roughed-in frames (403) to which finishing strips (64) are attached to define a peripheral ledge against which can rest an unmounted door (65). In this embodiment, only the closure member (66) is used and no insulation frame (20) or (38) is used, as is the case in previously described embodiments. Most commonly in this embodiment, the opening (12) will be an opening in a generally vertical wall, such as is the opening shown with respect to a different embodiment in FIGS. 17-18 but may also be in a ceiling hatch.

As shown in FIG. 7A, the closure member (66) is constructed in the same manner as the closure member described with respect to FIG. 1, having a depending central portion (67), which is of a size to fit closely, and in some embodiments snugly, about the inner circumference within the structural or roughed-in frame (403). A peripheral flange (68) of the closure (66) extends from the body and is designed to provide a seal against a second surface (69) of the structural frame (63). Although not shown, handles may be provided. The closure (66) may be constructed of the same insulating, air-sealing, and/or noise abatement material described with respect to previous embodiments, such as shown in FIG. 1, and may be sealed with a plastic sealing material or coated with a fireproof coating, or both, as previously described.

As shown in FIG. 7A, the closure (66) includes one or more body portions that extend downwardly to make the insulating seal in a circumstance where the structural or roughed-in frame (403) is not coextensive with the circumference of the opening (12). With such an incomplete structural or roughed-in frame (403), the access opening may be connected with channels (602) that run between and parallel to ceiling or wall joists (603), which channels (602) would normally be interrupted at the opening (12) by a complete structural frame (403). If not sealed by a structural frame (403), the channels (602) provide a breach in the insulating seal about the access opening. Body portions (67) of sufficient length so as to extend to cover the channels (602) may be used to compensate for the sections of the circumference of the access opening (12) that would otherwise be sealed by the frame (403). These portions (67) may extend the entire length of the closure (66) or may be just toward the edges with a more standard depending central portion (27) extending over the actual opening (12). In such case, such downwardly extending body portions (67) may be sized and shaped to fit snuggly about one or more ceiling joists or wall studs (603), the ends of which abut the access opening (12).

In an alternate embodiment, a partial insulating frame extends along a portion of the circumference of the opening (12) for which there is no structural or roughed-in frame (403) closing the channels (602). After the partial insulating frame piece is set in place about the joists or studs (603), thereby closing the channels (602) and completing the frame about the access opening (12), a closure (66) can be closely fit within the access opening (12) neatly against the structural or roughed-in frame (403) and the partial insulating frame having portions that extend to close the channels (602) so that the opening (12) is sealed. In an embodiment the hatch (65) could be eliminated totally in this embodiment allowing the depending portions (67) to be visible.

While in FIG. 7A an embodiment where the closure member (166) includes portions (67) to extend between structural building components, the embodiments of FIGS. 22-26 provide for alternative embodiments of a frame (20) which may be assembled to provide for elongated tabs (401) to extend between joists (603) and are designed to fill in between the joists (603). In the embodiments of FIGS. 22-23, a frame (20) is shown which includes two elongated tabs (401A) and (401B). The tabs (401) extend generally perpendicularly from the plane of the frame (20) and are arranged at opposing walls of the frame (20). Depending on the embodiment the tabs (401) may be designed (as shown in FIGS. 22 and 23) to be attached to the underside of the frame (20) or may be formed as a portion of the frame (20). In this embodiment, the frame (20) is generally designed to be a fixed size and would generally be formed to be purposefully large in at least one dimension compared to the type of opening (12) it was designed to be used with.

The inclusion of such a fixed shape frame (20) with specific tabs to allow for the frame (20) to be used with a number of differently sized openings (12) can provide for a number of benefits on the universality of the cover (10). Specifically, the frame (20) is sized and shaped to snuggly engage the closure member (26) even in situations where the opening (12) to be sealed is significantly smaller than the closure member (26) could otherwise accommodate as the opening (12) may be smaller than the depending portion (27).

With regards to FIG. 22, the cover (10) is shown in place in an embodiment with only the joists (603), and in such respects, is similar to the embodiment of 7A. In FIG. 23, the device (10) is shown in place in a hatchway opening where the frame (20) is purposefully made too big in one dimension for the opening (12). As can be seen, the structural frame (403) in this case is actually enclosed, on two sides, by tabs (401) which extend down to the ceiling material (generally drywall) through which the attic opening (12) exists. Specifically in this case, the elongated tabs (401) serve to form a seal with the existing floor joists (603), and with the back side of the ceiling (409) so that the portion under the closure (26) is sealed from the rest of the attic space. Further, the height of the tabs (401) is sufficient to go above existing structural frame (403). As discussed in conjunction with FIG. 1, in an embodiment one side of the frame may be removable to improve access. In this situation, a tab (401) if on the access side, may also be removable to allow passage through the frame (20).

FIG. 24 provides for an alternative embodiment. In the embodiment of FIG. 24 the tabs (401) are not positioned in line or below the frame (20) walls, but are positioned beside and adjacent to the frame (20) walls in an overlapping arrangement. This allows the tabs (401) to be sized for more universal positioning in a variety of situations. The floor joists (603) will often not be of a standardized height, and therefore the tabs of FIG. 7A, 22 or 23 can potentially need to be cut down in order to fit. In the embodiment of FIG. 24 tabs (401) may be provided which are longer than would be required in a vast majority of installations and they can then be placed between the joist (407) adjacent to a side of the frame (26). As the joists (407) are outside the frame (20), they will generally not interact with the closure member (26) as they are clear of it.

Figure 20:
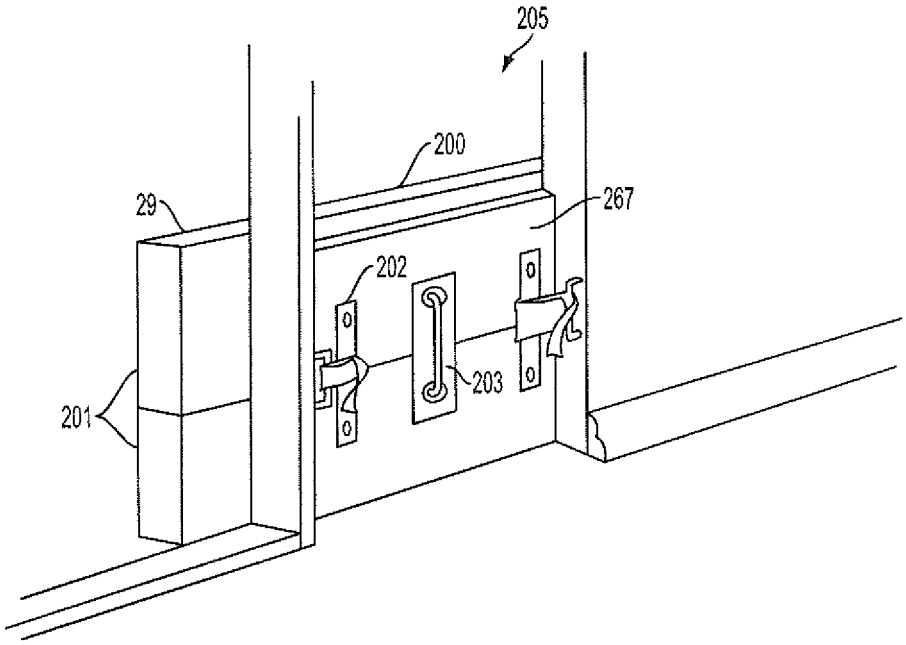
FIG. 20 shows a side perspective view of another embodiment of a cover placed in a wall opening.

The design of FIG. 24 can be particularly useful in situations where the hatchway or other opening is of a non-standard size, where there is a hole cut for attic access without any structural framing (403) being provided, or wherever it is necessary to position the cover around other structures. It can also be useful where there is a desire to hold insulation and other material used to insulate the attic away from the structural attic opening (12). As should be apparent, insulation will generally be placed in the attic in close proximity to the structural frame (1403). In some embodiments, this may be undesirable as it may make it easier for the insulation to fall into the opening. By positioning the elongated tabs (401) between the floor joists (407) and blocking access, the insulation may be pushed further from the opening (12) without loss of insulative capacity. Further, in the embodiment of FIG. 24, as also shown in FIG. 20, the flanges (29) of the closure (26) do not extend to the outer perimeter of the frame (20) which allows for better clearance in certain types of trussed ceilings.

In FIGS. 22 and 23, the elongated tabs (401) are attached to the rest of the frame (20). While similar to the embodiment of FIG. 24, in FIG. 23 the frame (12) is capable of contacting the wooden structural frame (40) of the attic, but is slightly too large with the frame (20) extending over the frame (403) and only contacting a portion of it. In this case, the elongated tabs (401) are positioned adjacent to the structural frame (403) and are positioned under the walls of the frame (20) but are not in line with the frame (20) walls. In this way, the frame (20) rests on the tabs as the frame (20) surrounds the structural frame (403). This can serve to improve the ability to seal the frame (201) to the structure of the house by encapsulating the whole structural frame (403). In the embodiment of FIG. 23, the elongated tabs (401) effectively serve to widen the structural frame (403) to allow the frame (20) to have a more solid connection, and in an alternative embodiment, the frame (20) may contact both the tabs (401) and the structural frame (403) to further improve the sealing capacity.

Figure 25:
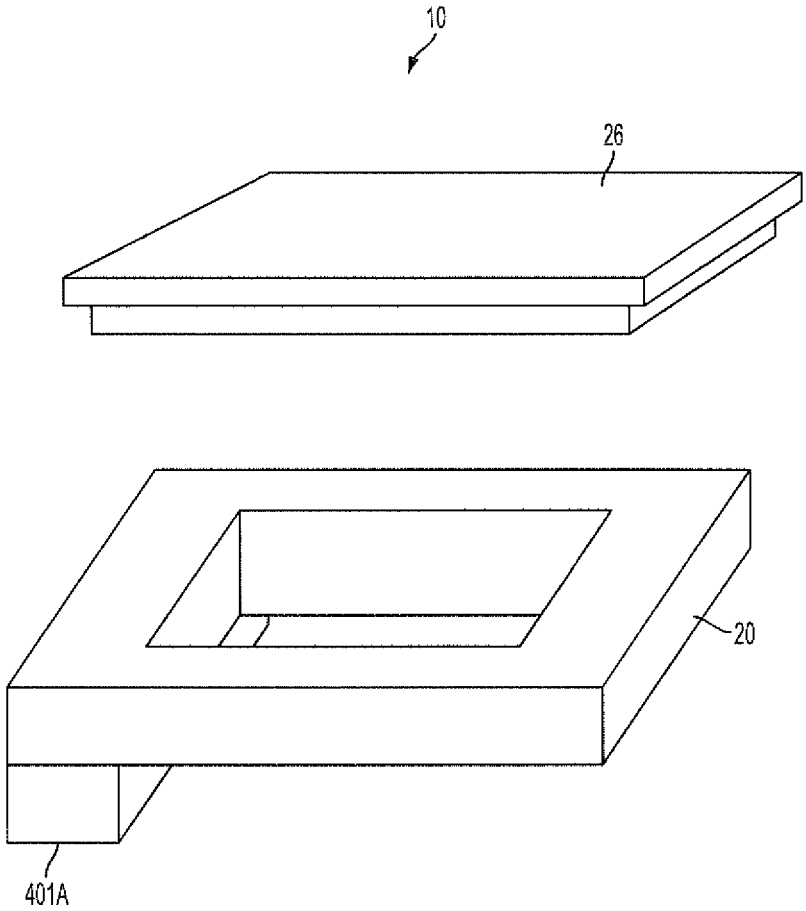
FIG. 25 provides a perspective view of a cover where the insulating frame includes a single elongated tab.

While the above discussion of FIGS. 22-24 contemplates a frame having two or more elongated tabs (401), one of ordinary skill would understand that only one tab (401) is actually necessary to perform an installation and FIG. 25 provides for a still further embodiment which utilizes only a single tab (401A). This embodiment is useable with the structural frames (403) of FIGS. 23 and 24. However, in such an installation, the frame (20) is aligned so that one of the walls is placed on the structural frame (403) while the other would generally be placed beyond the opposing structural frame (403) on tab (401A).

Figure 26:
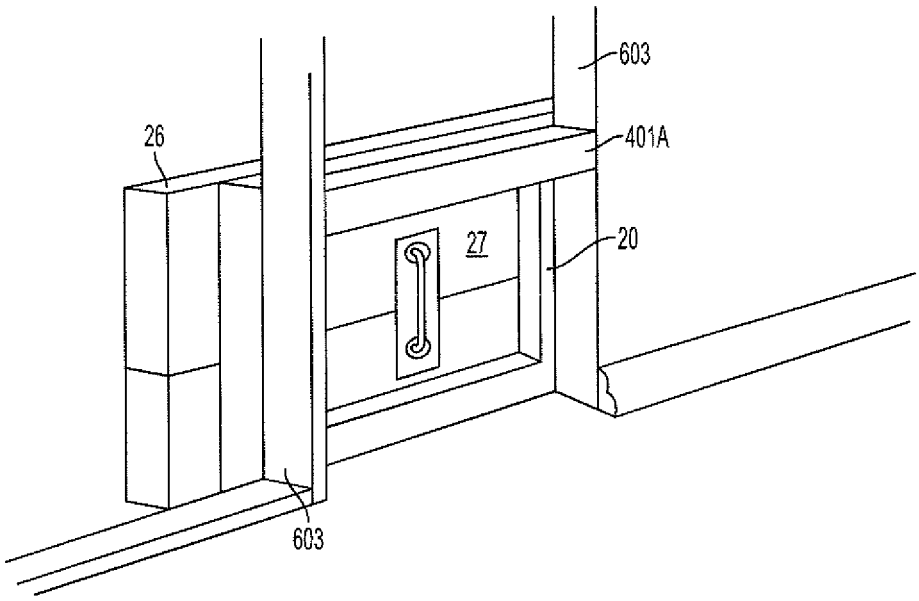
FIG. 26 provides a perspective view of the device of FIG. 25 in place in a kneewall attic opening where there is no between joist framing but there is a floor or other base portion of the framing.

The device of FIG. 25 is also commonly useful in a vertical installation, such as for a knee wall. This is shown in FIG. 26. In this embodiment, there is often a floor on the attic side of the door (204). Alternatively, because the door (204) is at floor level, there is often a support frame piece directly below the door (204) to insure structural integrity. However, as the opening (12) may be cut between studs (joists) (603), the top portion of the door (204) on the attic side may be open. The single tab (401A) may then be used to provide sealing in this area. In a still further embodiment, the frame (21) may be "U" shaped so that there is no frame end (22) on the floor.

As should be apparent from FIG. 26, this embodiment is generally useful as a more universally sized item. As there is often only a single side of a knee wall opening (12) that is open, the cover (10) can be made larger than most knee wall openings (12) so as to insure that it is useable with a wide variety of different walls.

It should be apparent that the elongated tabs (401) can be provided as separable pieces as part of a sealing kit. Specifically, the elongated tabs (401) can be provided with the other components forming the frame (20) and closure member (26) allowing the installer to use them, if needed, or discard them if not. Still further, the tabs (401) can be used elsewhere in the construction if desired. For example, they may be used to form the connection of FIG. 7B if not otherwise used or can be used in a frame extension of the form of FIGS. 13-16.

Figure 7B:
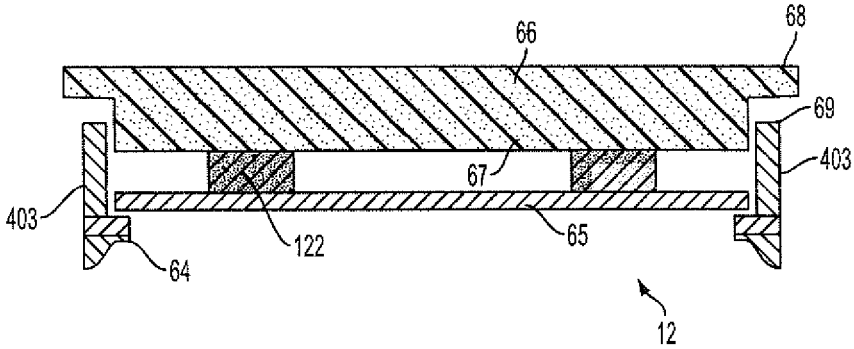
FIG. 7B a cross-sectional view of an alternate embodiment of a closure which is attached to an unmounted door.

In the embodiment of FIG. 7B, an unmounted door (65) is connected directly or via connection members (122) to the closure member (66). In this way, both the door (65) and the closure member (66) are simultaneously displaced when a person moves either of them. Such a connection may make entrance and exit from the attic more convenient. Such a connection can also be made through an insulating frame having a depending portion such as shown in FIG. 2, wherein the depending portion contacts and is connected to an unmounted door, and whereupon the lifting of the unmounted door also moves the insulating frame and closure connected thereto.

In some instances, attic access openings are relatively small or positioned close to a roof line thereby limiting the ability to insert single piece closure members into position. The present embodiment includes variations wherein the closure member (26) is formed of two or more interfitting components which may be fit together after being inserted through an access opening.

Figure 8:
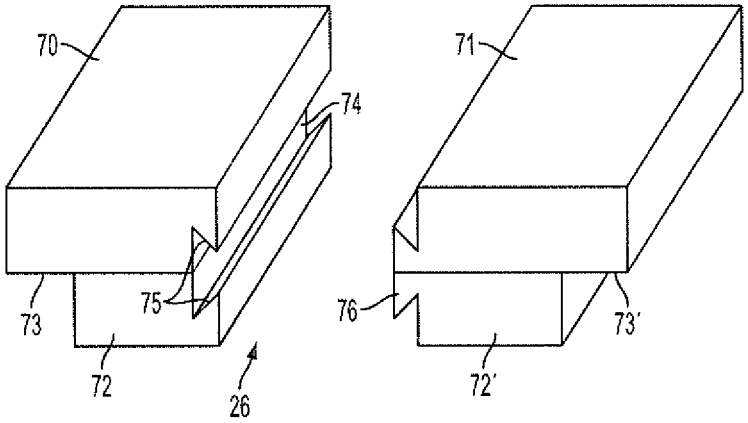
FIG. 8 is a perspective assembly view showing an embodiment of a closure that is formed from two interlocking components.

In an embodiment, shown in FIG. 8, the closure member (26) includes two components (70) and (71), each having a body segment (72) and (72'), respectively, and upper flange segment (73) and (73'), respectively. Component (70) includes a channel (74) having opposing beveled side walls (75) into which an elongated tongue or flange (76) of the opposing component may be slidingly received to fit the components together. The shapes of the channel (74) and tongue (76) are such that the two components (70) and (71) may be interlocked by sliding relative to one another to thereby form a single closure member (26). These interlocking segments are an example of cooperative surfaces of the components of the closure member (26). In an embodiment, adhesive or glue is applied to the joint at channel (74) or tongue (76) or both prior to fitting together the components (70) and (71), in order to bond the components together at the tongue (76) and channel (74). Application of an adhesive tape may be made at the time of manufacture for the same purpose, such that the end user need not apply glue or adhesive during assembly.

Many variations of cooperative surfaces, such as variations in the shape and size of the tongue (76) and channel (74) are exhibited in various embodiments, some examples of which are shown in FIGS. 9-12. These can be used to connect the walls to each other (both permanently and/or temporarily) in formation of the frame (20), to form the walls or closure (26) from component pieces, to connect parts of the closure (26) to form the closure (26), or to connect the closure (26) to the frame (20). The general configuration of, and the materials from which the assembled cover (10) is formed, may be the same as discussed with respect to the previous embodiments. In the drawing figures, only a portion of each closure is shown for purposes of illustrating the interlocking relationship therebetween. In some embodiments the cooperating surfaces do not interlock, such as does a tongue and channel, but are simply shaped to have cooperating surfaces, for example, as would be created when an integral closure is cleanly cut into two pieces. The surfaces created by the cut necessarily are cooperating surfaces, since they have correlated shapes. No cut is necessary to make cooperating surfaces, though, since cooperating surfaces can be formed during manufacturing of closure components.

Figure 9:
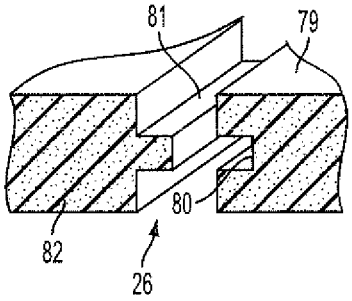
FIGS. 9-12 are partial cross-sectional views of an alternate embodiments of interlocking components wherein the interlocking surfaces have various structures.

In FIG. 9 a variation is disclosed in which the closure member (26) includes a first component (79) having a generally u-shaped channel (80) into which a protruding tongue (81) of an opposing component (82) may be received. The components may be secured as previously described to thereby form a single closure member (26). An adhesive may be used to bond the components at the joint.

Figure 10:
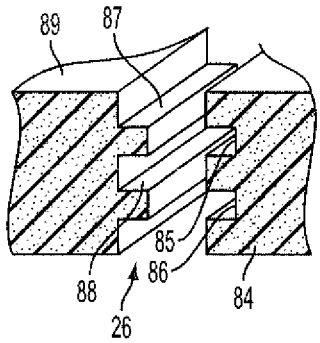

In FIG. 10, the closure member (26) includes a first component (84) having a pair of slots (85) and (86) which are generally u-shaped in cross-section and which receive protruding tongues or flanges (87) and (88), which extend from an opposing edge of frame component (89). The components may be secured as previously described to thereby form a single closure member (26). An adhesive may be used to bond the components at the joint.

Figure 11:
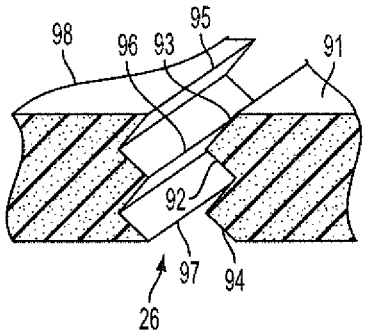

In FIG. 11, another type of sealing relationship is disclosed between opposing edges of two components of a closure member (26). In this variation, the closure member (26) includes a first component (91) including a central v-shaped channel (92) defined by opposing beveled edges and outer beveled edges (93) and (94). The beveled edges cooperate with elongated tapered flanges (95), (96) and (97) defined along the opposing edge of component (98) such that when the members are seated with respect to one another, a very tight seal is created therebetween. The components may be secured as previously described to thereby form a single closure member (26). An adhesive may be used to bond the components at the joint.

Figure 12:
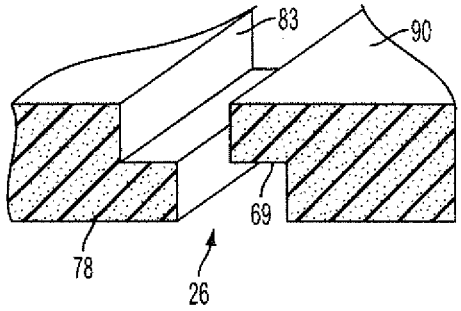

With specific reference to FIG. 12 a further variation of the present embodiment is disclosed. In this embodiment, the closure member (26) includes a first component (90) having an L-shaped cut-out or recess formed along each of the side and end walls, as shown at (101), which is of a size to cooperatively engage an L-shaped cut-out (69) formed in the opposing edge portion of component (78). The components may be secured as previously described to thereby form a single closure member (26). An adhesive may be used to bond the components at the joint.

Embodiments of the insulating cover (10) for use at the top of a stairway are shown in FIGS. 13-16, 21, and 30-32. This cover (300) is used in a storage space entrance accessed via a set of stairs (14). The storage space may be at either the top of the stairs (140), as would be an attic, or at the bottom of the stairs (140). Although the embodiments shown in FIGS. 13-16, 21, and 30-32 have an overall rectangular shape, the shape of the cover (300) need not be rectangular, and can be any shape needed to fill the opening (12) at the top of a stairway (140), including shapes that can generally be referred to as an L-shape or a U-shape.

Figure 13:
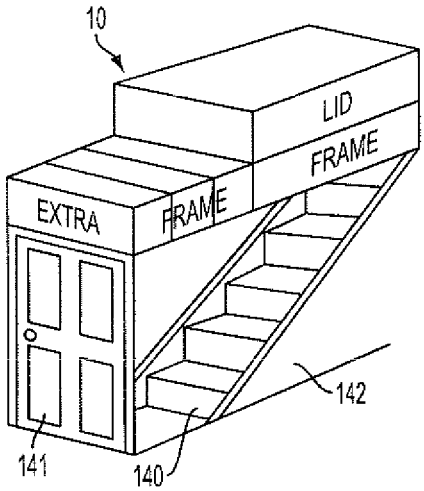
FIG. 13 shows a perspective view of a cover used in a stairwell opening.

In an embodiment, such as is shown in FIG. 13, the stairway (140), and therefore the storage space, is accessed through a wall opening in which is mounted a door (141). In such case, the stairway (140) typically exists within a stairwell, which is the shaft through which the stairway (140) runs. In an embodiment the stairwell shaft is generally enclosed by the stairs (140) on the bottom and walls, two generally vertical side walls (142) and a top wall (ceiling) generally parallel to the stairway (140). Alternately, in an embodiment, the stairway (140) is an "open" stairway, either without a top wall or without any walls (142), typically then having only a railing. In other embodiments, there may not be a door (141) as the stairway may extend through the vertical wall.

Figure 14:
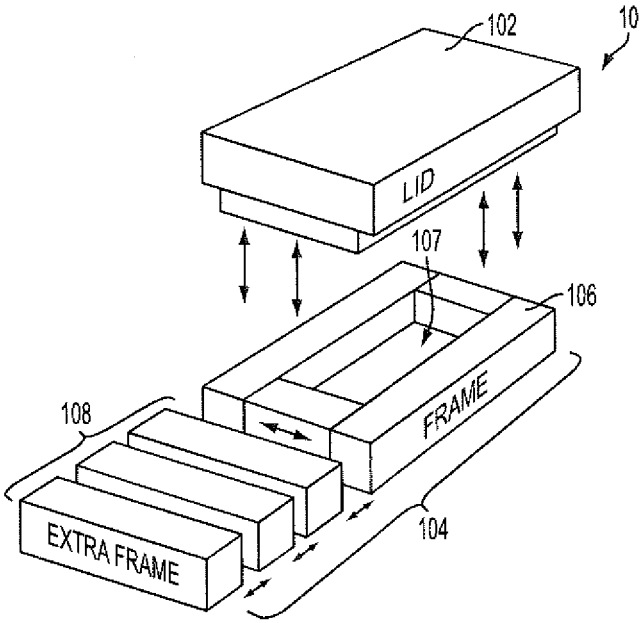
FIG. 14 shows a perspective view of the cover FIG. 13 apart from its environment of use.

The insulating device (300) of FIG. 13 is shown independently of the environment of its use in FIG. 14. The device (300) is comprised of two components, a closure (102) and a frame (104). As with the first embodiment shown in FIG. 1, the closure (102) is designed to fit closely in association with a portion of the frame (104) to provide an insulating device. The fit may be accomplished by any of the methods discussed above, such as the frictional engagement of the depending central portion of the closure (102), or a beveled engagement as described with respect to FIG. 5, or, preferably, simply a close, but not snug, fit between a depending central portion and the internal surfaces of the frame.

The frame (104) is generally comprised of two portions, a first portion (106) that has an internal aperture (107) that is shaped to fit closely with and be closed by the closure (102), as discussed above, and a second portion (108) that does not have an opening, and that extends the frame (104) to cover the entire stairway opening (12) cut into the storage space floor. The second portion (108) may extend the frame (104) in any one or more spatial directions in order to fit over the entire stairway (140) opening in the floor of the storage space. As shown in FIGS. 13-14, the second portion (108) extends the frame (104) along a spatial direction generally parallel with the stairs (140). As shown in an alternate embodiment in FIGS. 15-16, the second portion (108) extends the frame (104) along two spatial directions, one direction being generally parallel with the stairway (140), and the other direction being generally perpendicular thereto.

In the depicted embodiments, the internal aperture (107) in the frame (104) is sized and shaped to allow an individual human to pass therethrough in a manner that is reasonably comfortable for the person when walking up the stairs (140). The aperture (107), however, may be of any size and shape. In particular, in an alternative embodiment, the aperture (107), may be significantly larger than shown, such that the aperture (107) encompasses a greater proportion, or all, of the stairwell opening as shown in FIGS. 30-32. Generally, a larger internal aperture (107) in the frame (104) requires a larger closure (102), which easily may become too unwieldy to be practical. Generally, a smaller closure (102) is easier for a person to maneuver when engaging and disengaging the closure (102).

Figure 15:
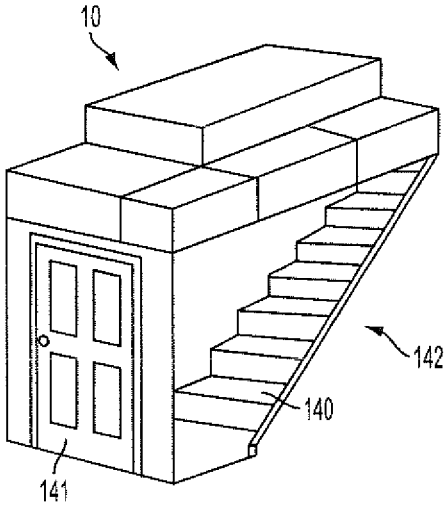
FIG. 15 shows a perspective view of an alternate embodiment of a cover used in a stairwell opening.
Figure 16:
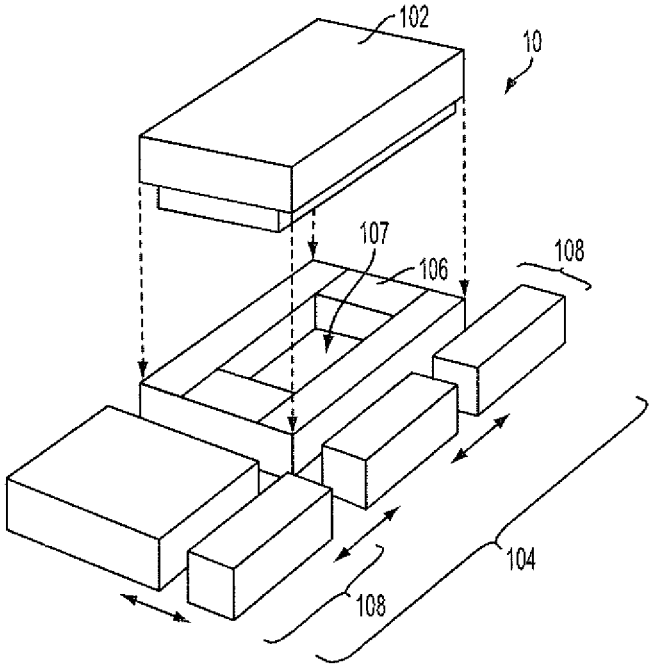
FIG. 16 shows a perspective view of the cover of FIG. 15 apart from its environment of use.
Figure 21:
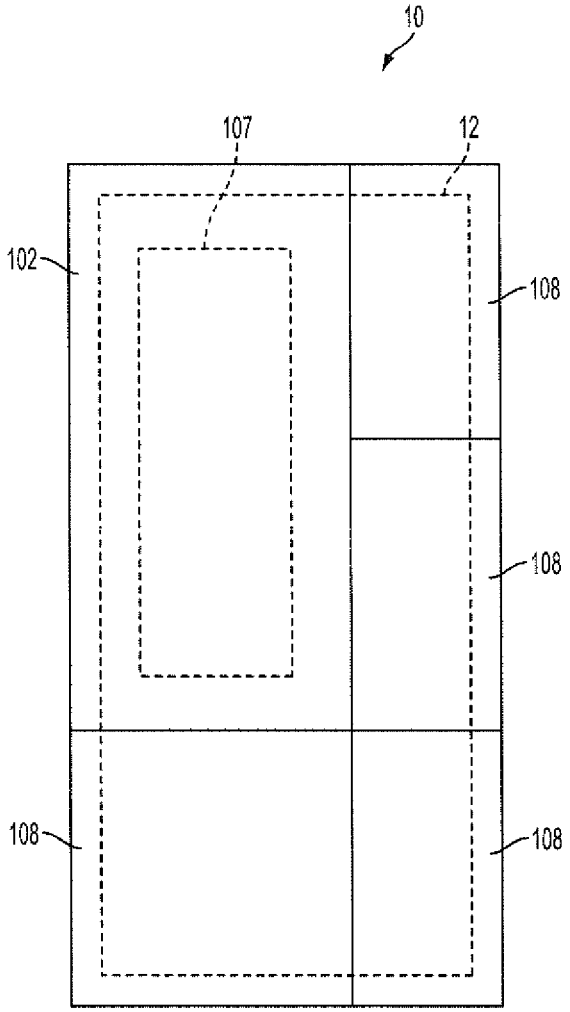
FIG. 21 shows a top-down planar view of the embodiments of FIGS. 15 and 16 in place over an attic opening.

As indicated in FIGS. 13 and 15, the frame (104) is designed to be larger than the opening (12) cut into the floor of the upper-level storage space to allow access by the stairs (140). This is shown in FIG. 21. Where the stairwell walls (142) do not extend above the storage space floor, the frame (104) may simply rest on that floor, as discussed with reference to FIG. 1. In this way, both the closure (102) and the frame (104) may remain movable, providing the greatest flexibility for accessing the storage space without having any portion of the insulating device interfering with such access. Alternately, the frame (104) may be attached (or partially attached to allow an opening in the frame (104) to be created) to the attic floor by any suitable method, such as those described above, including an adhesive, and specifically including a caulk. In a further alternate embodiment, the frame (104), including either or both of the first and second portions (106) and (108), may be fabricated with a depending flange, such as discussed above with respect to FIG. 2B or may be attached using weather stripping, gaskets, or other known sealing methodologies.

Where the stairwell walls (142) extend above the upper-level storage space floor but not to the ceiling thereof, if such ceiling is present, otherwise to the rafters thereof, the frame (104) may rest on or be attached to the top of the stairwell walls (142). In this case, a vertical extension of the frame (104) may be necessary to close the opening at the top of the stairs (140) between the storage space floor and the top of the stairwell walls (142). Alternately, where the stairwell wall (142) extends above the attic floor, the frame (104) may be attached directly to the vertical face of the stairwell wall (142) at any appropriate height, such as the height of the storage space floor. Where the stairwell is enclosed, as discussed above, the frame (104) may be attached to the shaft walls and the stairway (140).

Each of the closure (102), and the frame (104), including the first portion (106) and second portion (108), may be further comprised of components attached together with any suitable manner for so attaching. Examples of ways in which to attach together components of the closure (102) and frame (104) include the use of interlocking shapes, such as discussed above, particularly with respect to FIGS. 8-12; the use of an adhesive, such as a glue or caulk; the use of an adhesive tape, such as a double-sided adhesive tape; the use of a post or pin attached to and extending from a first component and into a second component to which it is also attached; and the use of straps, such as straps connected to and extending generally perpendicularly across a joint between each of two abutting components. A pin or post for such purpose may have a variety of shapes and sizes, including having a head or not on either or both ends or having flanges or barbs to aid in securing the pin to the component. Any of these attachment methods may be used alone and more than one method of attachment may be used to attach one component to another. An advantage of constructing the cover (10) of components is that the components can be shipped independently and can be put together at or near the place of installation of the cover (10).

Another embodiment of a device for use with a staircase is shown in FIGS. 30-32. In these embodiments, the frame (104) is sized and shaped so as to provide a single large opening (107) which corresponds with the opening (12) in the floor for the stairway (140) walkup. In this embodiment, the closure member (102) which is now quite large and i.e. is a single piece, includes a triple seal. Alternatively, as in the embodiment of FIG. 32, the connection need not actually comprise three seals but may actually comprise a single, a double or a triple seal. The remaining portions being used to help position the closure member (102) as contemplated in conjunction with FIG. 32. This latter embodiment is particularly desirable in conjunction with a stairway walkup of the embodiment of FIGS. 30-31 as the closure member (102) is so large. In an embodiment, the closure member (102) may only form a single seal corresponding to the adjacent placement of the top of the channel (143) on the top of the frame (104). The depending portion (145) and the exterior depending border (147) may be used solely for positioning to make sure that the single seal is formed and providing a tortuous air path.

As can also be seen in FIG. 32, with a large cover (300) as shown in FIGS. 30-31, the closure (102) may be provided in individual movable pieces (102A), (102B), and (102C), to provide that the closure (102) may be separated from the frame (104) in pieces.

Another embodiment is the insulating device (200), shown in FIGS. 17-20. This cover (200) is used to insulate a wall-entrance opening (205) to a storage space. Such an opening (205) may occur as an entrance through a wall to an attic-type space above the eaves of a house, may occur as an entrance to a stairway leading to a storage space, or may occur anywhere the space generally used for daily living is divided from non-living space by a vertical wall with an opening therein. Such an opening may have a door, such as a simple plywood cover (204), generally used to separate the spaces on either side of the opening (205).

In an embodiment, this device (200) is a closure without a frame, however, a frame may be used in other embodiments such as that shown in FIGS. 25 and 26. The closure (200) may be comprised of component portions (201), such as the three component portions shown in FIG. 17. The closure (200) is generally designed to be larger than the wall opening (205) being insulated by the closure (200). An advantage of providing the closure (200) in more than one component is in getting the closure (200) through the opening (205) into the storage space. Once in the storage space, the component portions can be attached together to form the closure (200). Attachment may be achieved by any suitable method, including those described above for the attachment of components of the frame (104) or (20) or cover (102) or (26), such as an interlocking joint, an adhesive, an adhesive tape, a post or pin, a strap (202), or any combination thereof.

As discussed above with respect to other devices, the closure (200) may have one or more handles (203).

As shown in FIG. 20, in an embodiment, the insulating device (200) is fabricated to include a depending central portion that extends into and frictionally engages to fit snuggly in the opening (205). Depending on the shape of the opening (205), the protrusion (267) may not be arranged centrally, but may be offset to allow the device (205) to be positioned on a floor forming one side of the opening (205). Such a snug fit may alternatively be designed similarly to the fit between the depending central portion (67) of the closure member (66) and the structural or roughed-in frame (63) shown in FIG. 7A. In an embodiment, the protrusion (267) fits closely, but not snuggly, with the frame or opening (205) as contemplated elsewhere in this disclosure.

In an alternate embodiment, the insulating device (200) has no protrusion (267) for extending into the opening (205), but has a surface that can be held tightly against one side of the opening (205). By tightly fitting against one side of the opening (205), the thermal and acoustic properties of the device are enhanced as compared with a circumstance where the device (200) is poorly engaged with the opening (205). The snug fit against one side of the opening (205) may be achieved through the use of straps (206) that maintain a certain tension, which provides a force generally pulling the closure (200) against the opening (205). The straps (206) may be made to be an integral part of the closure (200) during assembly of the components (201) of the closure (200). To further improve insulating properties, weather stripping or a similar material may be placed around the periphery of opening (205) so that the device (200) interacts with the weather stripping or similar material when the closure is tensioned against it. The straps (206) are more generally any practical connector that can maintain the position of the device (200) in a closing relationship to the opening (205). Other examples of such connectors include chains, hooks, or other connectors which can be used to secure the device (200) tightly or create tension between the device (200) and the periphery of the opening (205).

Figure 17:
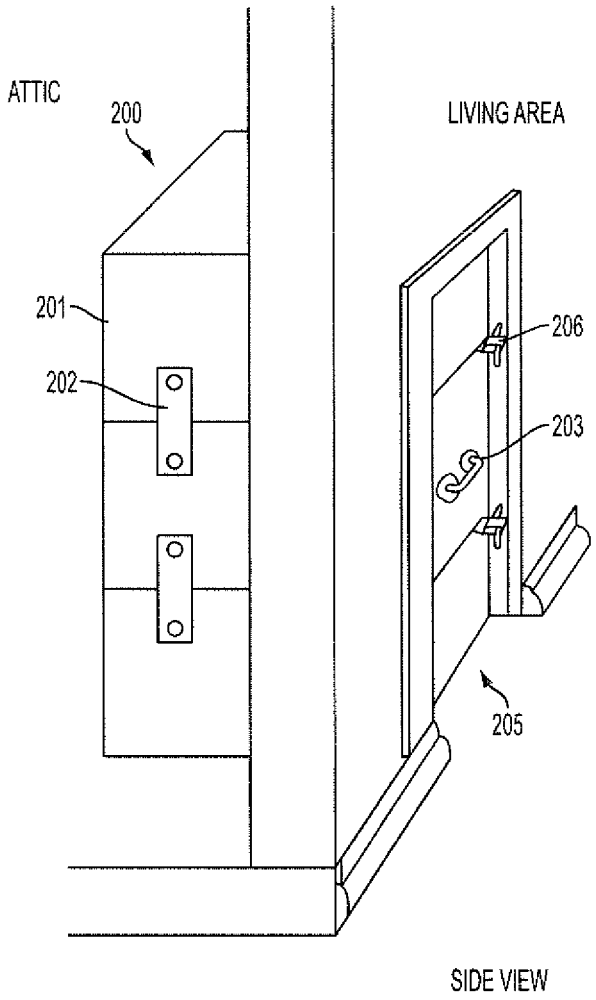
FIG. 17 shows a cut-away perspective view of a cover used in a generally vertical wall entrance opening.
Figure 18:
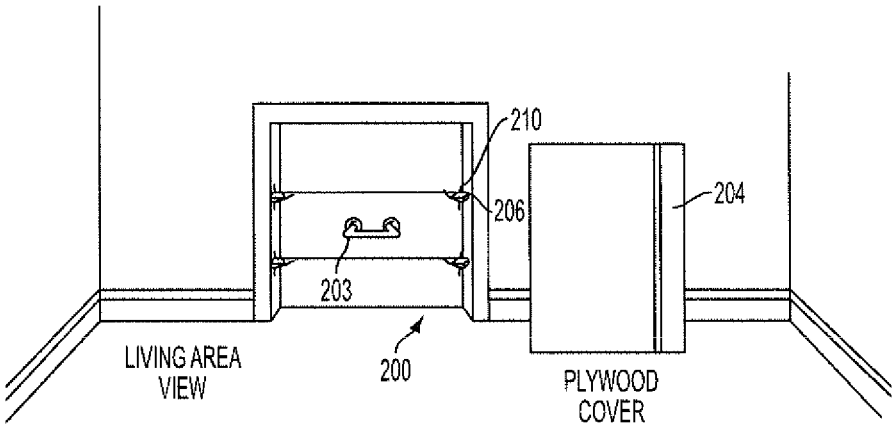
FIG. 18 shows front perspective view of the cover of FIG. 17.
Figure 19:
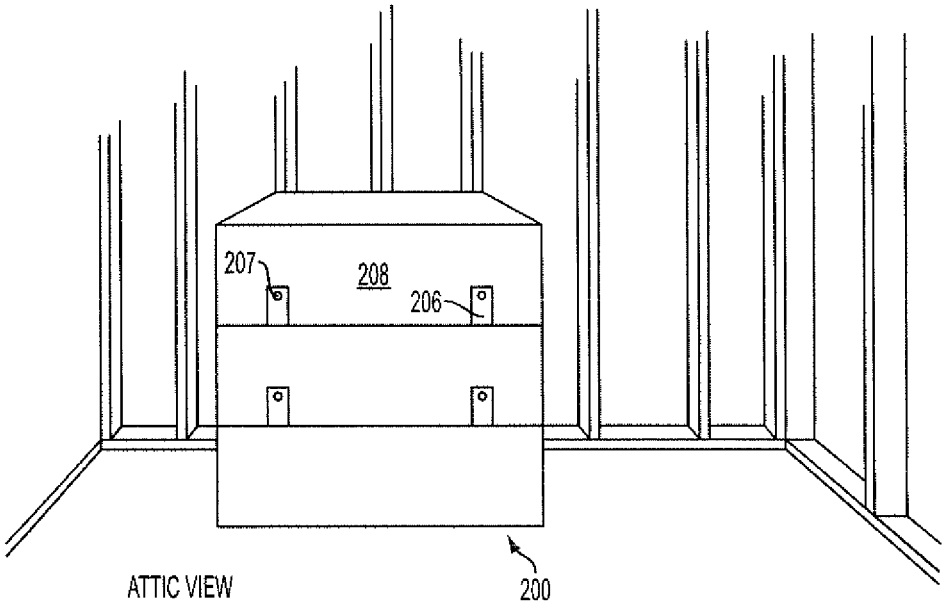
FIG. 19 shows a back perspective view of the cover of FIG. 17.

In an embodiment as shown in FIGS. 17-19, the straps (206) are placed between the component portions (201) before the component portions (201) are attached together. In this way, the straps (206) are attached to the closure (200) between the component portions (201). The straps (206) may be made more secure to the closure (200) by the wrapping of a length of the strap (206) around the back side (208) of the closure (200), and securing the wrapped end of the strap (206) with a pin, nail, or other similar device (207) that protrudes through the strap (206) and into the closure (200).

Once constructed and placed in front of the opening (205), the closure (200) may be pulled against the back of the opening (205) by pulling on the handle (203) or on the straps (206). The closure (200) seals against the frame of the opening (205) or the wall external to the opening (205), such frame generally including a portion of the floor when the access opening (205) is open down to the floor rather than being elevated off the floor. To maintain the snug contact of the closure (200) with the frame of the opening (205) or the wall about the opening (205), the straps can be secured through the opening (205), such as to the structural frame thereof or to the wall on the opposite side as is positioned the closure (200), by any suitable method, including connecting with connectors to a post or eyelet or other protrusion (27) from the wall or the structural frame of the opening (205). In the depicted embodiment, the straps pass through a u-shaped loop or handle on the inside periphery of opening (205) and are looped back upon themselves to attach the strap (206) to itself, such as through the use of a hook and loop type fabric attachment device (such as those sold under the brand name of Velcro™), snaps, buttons, a buckle, or other similar devices.

While the inventions have been disclosed in connection with certain preferred embodiments, this should not be taken as a limitation to all of the provided details of any invention. Modifications and variations of the described embodiments may be made without departing from the spirit and scope of any invention herein disclosed, and other embodiments should be understood to be encompassed in the present disclosure as would be understood by those of ordinary skill in the art.

The invention claimed is:

1. An insulating cover assembly comprising:

a continuous frame having spaced side walls and spaced end walls, said frame defining a frame opening extending therethrough;

a removable closure member, said removable closure member including:

an upper portion forming flanges:

said flanges extending laterally outward relative to said depending central portion;

said flanges being sized and shaped to engage an upper surface of each of said side walls and end walls to create a continuous seal with said frame when said removable closure member is positioned on said frame in covering relationship with respect to said opening defined by said frame; and ends of said flanges extending beyond the outer perimeter of said frame when said removable closure member is positioned on said frame in covering relationship with respect to said opening defined by said frame;

a downward extending border extending from said flanges, said downward extending border being adjacent to, parallel to, and in contact with, said outer perimeter of said frame along substantially all of said downward extending portion, wherein said downward extending border engages said side walls and said end walls of said frame along said outer perimeter of said frame to create a continuous seal with said side walls and said end walls when said removable closure member is positioned on said frame in a covering relationship with respect to said frame opening;

wherein said closure member is completely detached from said frame when said continuous seal is broken.

2. The insulating cover assembly of claim 1 wherein said flanges and said upper surfaces include mating male and female connectors.

3. The insulating cover assembly of claim 2 wherein said flanges include said male connectors.

4. The insulating cover assembly of claim 2 wherein said upper surfaces include said male connectors.

5. The insulating cover assembly of claim 2 wherein said male and female connectors are arranged continuously over said flanges and said upper surfaces.

6. The insulating cover assembly of claim 2 wherein said male and female connectors are arranged in discrete areas of said flanges and said upper surfaces.

7. The insulating cover assembly of claim 6 wherein said discrete areas comprise said end walls.

8. The insulating cover assembly of claim 6 wherein said discrete areas comprise said side walls.

* * * * *